US005583528A

United States Patent [19]

Ebihara

[11] Patent Number: 5,583,528

[45] Date of Patent: Dec. 10, 1996

[54] ELECTROOPTICAL DISPLAY DEVICE

[75] Inventor: Heihachiro Ebihara, Tokorozawa, Japan

[73] Assignee: Citizen Watch Co., Ltd., Tokyo, Japan

[21] Appl. No.: 364,420

[22] Filed: Dec. 27, 1994

Related U.S. Application Data

[63] Continuation of Ser. No. 729,123, Jul. 12, 1991, abandoned.

[30] Foreign Application Priority Data

Jul. 13, 1990 [JP] Japan ..... 2-184147

[51] Int. Cl.[6] ..... G09G 3/20

[52] U.S. Cl. ..... 345/58; 345/94; 345/212

[58] Field of Search ..... 345/87, 93, 90, 345/58, 94, 212; 359/55; 358/240, 230; 363/54

[56] References Cited

U.S. PATENT DOCUMENTS

| | | | |
|---|---|---|---|
| 3,733,435 | 5/1973 | Chodil et al. | 340/805 |
| 4,525,710 | 6/1985 | Hoshi et al. | 340/784 |
| 4,635,127 | 1/1987 | Togashi | 358/230 |
| 4,675,798 | 6/1987 | Jost et al. | 363/54 |
| 5,130,703 | 7/1992 | Fairbank et al. | 340/784 |

FOREIGN PATENT DOCUMENTS

| | | | |
|---|---|---|---|
| 0303510 | 12/1988 | European Pat. Off. | 359/55 |
| 0374845 | 6/1990 | European Pat. Off. . | |
| 240528 | 6/1988 | Japan | 348/784 |
| 64-4197 | 1/1989 | Japan . | |

OTHER PUBLICATIONS

Publication titled Crosstalk–Free Driving Methods for STN–LCDs, proceedings of the SID, vol. 31/4, 1990, Los Angeles US, pp. 333–336, Yoshiya Kaneko et al.

*Primary Examiner*—Richard Hjerpe
*Assistant Examiner*—Amare Mengistu
*Attorney, Agent, or Firm*—Finnegan, Henderson, Farabow, Garrett and Dunner

[57] ABSTRACT

The present invention improves the drop of a contrast, the occurrence of cross-talk and the drop of a response speed by bringing the drive state of an electrooptical display device to theoretical values. In a display device including a display panel having common electrode groups and segment electrode groups, a common electrode drive circuit and a segment electrode drive circuit, the quantity of the current flowing through the display panel through the segment electrode drive circuit is detected by a current detection circuit consisting of a differential amplifier 101 and a resistor Ra and by a current detection circuit consisting of a differential amplifier 102 and the resistor Ra, and the common electrode drive voltage applied to the common electrode groups through the common electrode drive circuit is controlled by a differential amplifier on the basis of this current detection quantity, whereby the contrast is improve, cross-talk is eliminated, and remarkable effects are obtained.

34 Claims, 31 Drawing Sheets

$$VM = \frac{EA+EB}{2} - \frac{R}{r} \cdot (eA+eB)$$

V1−V2=V2−V3=V4−V5=V5−V6=Vs
V2−V5=Vc

ELECTROOPTICAL DISPLAY DEVICE

This application is a continuation of application Ser. No. 07/729,123, filed Jul. 12, 1991, now abandoned.

BACKGROUND OF THE INVENTION

1. Field of the Invention

This invention relates to a method of driving an electrooptical display device.

Although the electrooptical display devices to which the present invention is directed include all display devices which exhibit a capacitive property, such as a liquid crystal, an EL, and the like, the following description will be of a display device which uses a liquid crystal, by way of example.

2. Description of the Related Arts

FIG. 2 of the accompanying drawings is a wiring diagram showing the relationship between matrix electrodes and a drive circuit of a conventional simple matrix type liquid crystal display device. In this diagram, symbols X1 to Xm denote segment electrode lines; Y1 to Yn common electrode lines; 201 is a segment electrode drive circuit for driving the segment electrode line; 202 is a common electrode drive circuit for driving the common electrode lines; 203 is a control circuit for controlling the segment electrode drive circuit 201 and the common electrode drive circuit 202; and 204 is a drive power supply circuit for generating a power supply voltage for driving the segment electrode drive circuit 201 and the common electrode drive circuit 202 and generating a liquid crystal drive voltage to be applied to the segment electrode line and to the common electrode line through the two drive circuits 201 and 202.

A specific example system of the circuit construction are shown in FIG. 2, and FIG. 3 shows only one thereof, to simplify the explanation. Therefore, although the explanation will be given in detail on the basis of FIG. 3, the technical concept of the present invention also can be effectively applied to the drive circuits of the other systems shown in FIG. 2, for example.

In FIG. 3, a segment electrode drive circuit 301 comprises a logic circuit 305 for processing the signals sent from a control circuit (not shown in the drawing) and an output circuit 302*j* which selectively supplies +Vs or −Vs to the jth (j=1, . . . , m) segment electrode Xj on the basis of the instruction from the logic circuit 305. Namely, when a transistor 303*j* is ON and a transistor 304*j* is OFF, +Vs is applied to the segment electrode line Xj, and when the transistor 303*j* is OFF and the transistor 304*j* is ON, −Vs is applied to the segment electrode line Xj. A state wherein the two transistors 303*j* and 304*j* are simultaneously ON does not occur. The substrate of these transistors 303*j* and 304*j* are connected to positive and negative power supplies +Vd and −Vd, which are applied to the logic circuit 305, respectively (with the proviso that $|Vd| \geqq |Vs|$).

Further, the common electrode drive circuit 306 comprises a logic circuit 311 for processing the signals sent from the control circuit (not shown) and an output circuit 307*k* which selectively supplies +Vc or −Vc or 0 to the kth (k=1, . . . , n) common electrode line Yk on the basis of the instruction of the logic circuit 311. Namely, when a transistor 308*k* is ON and a transistor 309*k* and a (semiconductor) switch 310*k* are OFF, +Vc is applied to the common electrode line Yk, and when the transistor 308*k* and the switch 310*k* are OFF and the transistor 309*k* is ON, −Vc is applied to the common electrode line Yk. While, when the switch 310*k* is ON and the transistors 308*k* and 309*k* are OFF, zero (0) potential is applied to the common electrode line Yk. A state wherein at least two of the transistors 308*k* and 309*k* and the switch 310*k* are simultaneously ON does not occur. The substrate of these transistors 308*k*, 309*k* and the substrate of the transistor that constitutes the switch 310*k* are connected to the positive and negative power supplies +Ve, −Ve, which are applied to the logic circuit 311, respectively (with the proviso that $|Vc| \geqq |Vd|$).

Therefore, the difference voltage between the segment electrode drive voltage VXj (+Vs, −Vs) and the common electrode drive voltage VYk (+Vc, 0, −Vc) is applied to the pixel Pjk formed at the point of intersection between the segment electrode Xj and the common electrode Yk, and there are several methods of selecting the timings for selecting each of these voltages.

FIG. 4 is a diagram showing an example of the ideal voltage waveforms to be applied to the liquid crystal by using the circuit construction shown in FIG. 3. In this diagram, periods T1(t1), T2(t2), . . . , Tn(tn) represent those periods in which the first segment electrode Y1, the second common electrode Y2 and the nth common electrode Yn are selectively driven, and the period from the period T1 to the period Tn (or from the period t1 to the period tn) is one vertical scanning period. The respective pixels are driven by the voltage applied during the selection period, which is 1/n of one vertical scanning period, and during the non-selection period which is 1−(1/n) of one vertical scanning period. During the period T1, +Vc is applied to the segment electrode Y1 and the 0 potential is applied to the other common electrodes. During the period T2, −Vc is applied to the segment electrode Y2 and the 0 potential is applied to the other common electrodes. The system which reverses the polarity of the selective drive voltage whenever the row to be driven is selectively changed in this manner is referred to as a "row reversion system". In the subsequent vertical scanning period t1, . . . , tn the polarity of the selective drive voltage to be applied to each row is further reversed, and this system is referred to as a "field reversion system". Accordingly, the system shown in FIG. 4 is referred to as a "row reversion/field reversion system".

Furthermore, the drive voltage applied to the segment electrode is determined in accordance with the data which is to be displayed. Assuming that the pixel portion corresponding to the segment electrode Xa is to be displayed black throughout all the periods, the pixel portion corresponding to the segment electrode Xb is to be displayed white throughout all the periods, and the liquid crystal panel to be used is normally black (which becomes more and more transparent with an increasing applied voltage), then the voltages such as VXa and VXb shown in FIG. 4 are applied to the respective segment electrodes. For example, a voltage VY1−VXa is applied to the pixel Pa1 at the point of intersection between the common electrode Y1 and the segment electrode Xa, and the voltage waveform thereof is represented by VPa1 in FIG. 4. A voltage such as VPb1 shown in FIG. 4 is applied to the pixel Pb1 formed by the common electrode Y1 and the segment electrode Xb.

Assuming that the liquid crystal responds to the effective value of the voltage applied, the effective value of the voltage applied to the pixel Pa1 described above during one scanning period (hereinafter referred to as the "driving effective voltage") is expressed by the formula (1) below and the driving effective voltage applied to the pixel Pb1 described above is likewise given by the formula (2) below:

$$Voff = \sqrt{\frac{(Vc - Vs)^2 + (n-1)Vs^2}{n}} \quad (1)$$

$$Von = \sqrt{\frac{(Vc + Vs)^2 + (n-1)Vs^2}{n}} \quad (2)$$

The difference between the formulas (1) and (2) given above appears as the difference of the display state (dark and bright). Accordingly, the greater this difference, the better the display, and the condition that provides the best display state is that under which the quotient (Von/Voff) obtained by dividing the formula (2) by the formula (1) becomes the greatest, and is given by the formula (3) below. The quotient (Von/Voff) at this time is given by the formula (4) below:

$$\frac{|Vc|}{|Vs|} = \sqrt{n} \quad (3)$$

$$\frac{Von}{Voff} = \sqrt{\frac{\sqrt{n}+1}{\sqrt{n}-1}} \quad (4)$$

The ratio |Vc|/|Vs| is referred to as a "driving voltage ratio" and when the driving voltage ratio satisfies the formula (3), the ratio is referred to as an "optimum driving voltage ratio". The values Voff and Von are determined primarily when Vc and Vs are decided. A driving effective voltage outside this range cannot be applied in principle, but a driving effective voltage between Von and Voff can be applied. An example of the segment electrode driving voltage waveform in this case is represented by VXc in FIG. 4. When such a means is employed, a liquid crystal television apparatus requiring a gradation display can be accomplished.

When the formula (3) is employed, the value |Vs| that provides the maximum contrast can be determined when |Vc| is set to a certain value, and the contrast drops at values other than this |Vs| value. Nevertheless, since the waveforms such as VXa, VXb, VXc, etc., shown in FIG. 4 represent merely the ideal state, and such an ideal state cannot be attained in practice because dull portions (inclusive of spikes) occur in the liquid crystal drive voltage waveform due to the influences of the parasitic resistance existing parasitically at each portion and the capacitance of the liquid crystal. Therefore, even if the drive voltage is set on the basis of the formula (3), to thus obtain the maximum contrast, the contrast that theoretically should be obtained cannot be obtained in practice. Namely, the greater the dullness of the drive voltage waveform applied across both ends of the liquid crystal, the greater the drop in the contrast.

Next, this dullness of the drive waveform leads to a drop in the response of the liquid crystal. Namely, the response of the liquid crystal is increased with a greater Von/Voff value, but if any dullness exists in the waveform, the value Von/Voff becomes smaller and the response of the liquid crystal drops. Accordingly, when a certain display having a quick motion is effected, an "after-image" or "image lag" phenomenon becomes more noticeable. Furthermore, the dullness of the drive waveform results in cross-talk, known conventionally as a critical problem, in the simple matrix type display device. When a display such as that shown in FIG. 5(A) is effected on a liquid crystal television receiver, for example, the practical display image becomes as shown in FIG. 5(B). In a display device of the type wherein a display panel is divided into upper and lower sections, to improve a driving duty ratio, and these upper and lower display panels are driven independently of each other, the display obtained in practice is as shown in FIG. 5(D), when an image as shown in FIG. 5(C) is to be displayed. This is because the dull portions appear in the voltage waveform applied to the liquid crystal, and the ideal state is not attained due to the influences of the output resistance of the drive power supply circuit 204, the internal wiring resistance of the segment and common electrode drive circuits 201, 202, the output resistance thereof, the connection resistance between both drive circuits and the display panel, the resistance of the outgoing electrode portion, and the like, as described above.

Also as described above, the dullness of the voltage waveform applied across both ends of the liquid crystal deteriorates all the characteristics of the liquid crystal display device, and in some cases, exerts an adverse influence such that the liquid crystal display device can no longer be used. Counter-measures employed in the past to solve this problem first stabilize the voltage to be given to the drive circuit from outside and then reduce the resistance of each part as much as possible, but it is practically difficult to make the resistance of each part zero and thus a certain degree of resistance always remains. Accordingly, in many cases the conventional counter-measures do not provide a sufficient effect.

The dullness of the waveform applied across both ends of the liquid crystal deteriorates all the characteristics of the liquid crystal display as described above. In contrast, the present invention is directed to improve the dullness of the waveform by a novel method, and to accomplish an ideal drive state, from all aspects. Since the cross-talk has been primarily discussed as the principal problem resulting from the dullness of the waveform, the explanation will be based mainly on the cross-talk problem, to thus clearly distinguish the present invention from the prior art technique.

A typical conventional explanation of the cross-talk is shown in FIG. 6. Assuming that all the pixels on line A display only white (or black), the column drive voltage of the line A is reversed whenever a row scanning is carried out, and whenever this reversion takes place, a charge/discharge to and from the liquid crystal as the capacitive load is effected. Accordingly, the dullness occurs in the waveform even during the non-selection period of the driving voltage VA applied to both ends of an arbitrary one of the pixels on the line A, as represented by VA in FIG. 6. Also, assuming that the pixels on line B pick up the display state where white and black are reversed at every line, the column drive voltage VB of the line B retains a predetermined value, and therefore, a charge/discharge to and from the liquid crystal during the non-selection period is not effected, and the drive voltage applied across both ends of the arbitrary one of the pixels on the line B becomes VB, as shown in FIG. 6. When the non-selection periods thereof are compared, the effective value of VA is found to be smaller than the effective value of VB, and thus the pixels which should appear at the same brightness are dark in the line A and bright in the line B. The conventional explanation regards this phenomenon as the cause of the cross-talk.

A proposal for an improvement based on the concept described above is disclosed, for example, in Japanese Examined Patent Publication No. 64-4197, and this prior art technique provides certain effects. These prior art inventions, however, are not directed to an improvement of the dullness of the waveform itself, but are directed mainly to making uniform the number of times of a charge/discharge that generates the dullness of the waveform, and further, assume that the display data are binary data (black and white). Accordingly, they are not effective for a gradation display such as a television image.

When the display data is binary data, a switching of the drive voltage conforms with the scanning switching timing of the common electrodes. Therefore, an adjustment can be made so that the effective value of each column at the time of a non-selection becomes uniform, regardless of the display pattern, by applying contrivances to the polarity reversion period of the row drive voltage to substantially equalize the number of times of a charge and discharge of each column at the time of a non-selection. In the liquid crystal television receiver having a gradation, however, a switching of the drive voltage of the segment electrodes does not always coincide with the scanning switching timing of the common electrodes, and thus the number of times of a charge and discharge cannot be adjusted even when the polarity of the row drive voltage is reversed.

The inventor of the present invention carefully examined the influences of the dullness of the waveform on the cross-talk, and found that there are some cases which cannot be fully explained by the concept shown in FIG. 6. The inventor therefore attempted to reproduce the liquid crystal drive state, to thereby analyze such cases. FIG. 7 shows a conventional model as the basis of the explanation of FIG. 6. The basic point in FIG. 7 is that a segment electrode, which originally should exist as a plurality thereof, is represented by one common electrode. Namely, among a plurality of common electrodes, a large voltage is selectively applied to only one electrode during a certain period, and all of the others are fixed at the zero (0) potential. Therefore, the influence of the selected common electrode is excluded by regarding it as sufficiently small as a whole, and an absolute greater number of common electrodes that are in the non-selection state can be collected as one electrode. Then, each segment electrode can be regarded as an aggregate of electrodes each having a capacitance c with respective to one common electrode which is at the zero (0) potential, and these segment electrodes can be regarded as being switched to +Vs and −Vs by the switches S1, S2, . . . each having an output resistance ro.

The problems with this reproduction are that only the resistance component of the segment electrodes is taken into consideration as the resistance component, and further, only the output resistance of the switches (corresponding to the transistors 303*j*, 304, in FIG. 3) is handled. It is true that the output resistance of the integrated liquid crystal driving circuit is on the order of kilo-ohms, and is by far greater than the resistance of the resistors added, but a resistance (inclusive of the output resistance) also exists in series in the power source line, although its value is small, and the sum of the currents flowing through a plurality of paths are associated with this resistance. Therefore, there may be case where this resistance cannot be neglected.

Particularly, the power supply line resistance involved in driving the segment electrodes is not taken into consideration in the explanation of FIG. 6, but this is believed to be a factor that cannot be neglected when the mode of appearance of the cross-talk in the liquid crystal television image is examined. Therefore, when the resistance of each power supply line is added to FIG. 7, the equivalent circuit becomes as shown in FIG. 8. In FIG. 8, a resistor RD is inserted to the +Vs power supply line, and a resistor RS to the −Vs power supply line. For the common electrodes, a resistor RM is added to the zero potential. This resistor RM includes the output resistance of the common electrode drive circuit (the output resistance of the semiconductor switch 310*k* in FIG. 3).

Since the cross-talk occurs when the drive waveform of the segment electrodes is different, the case whereby a plurality of segment electrodes are divided into two groups can be considered as an example thereof. FIG. 9 shows an example where N segment electrodes are divided into M electrodes and (N−M) electrodes. The equivalent capacitance CB of a group (hereinafter referred to as the "B group") comprising M electrodes is c·M, and the equivalent output resistance rB thereof is ro/M. Further, the group (hereinafter referred to as the "A group") comprising (N−M) electrodes has an equivalent capacitance CA of c·(N−M) and an equivalent output resistance rA of ro/(N−M). The B group and the group A are switched to +Vs and −Vs and are connected by the switch SB and the switch SA, respectively. The display state for each row in each of these groups is assumed to be the same.

The results of a simulation using this example during the non-selection state are shown in the following drawings. In the drawings, symbols SWA and SWB denote the state of the switches SA and SB shown in FIG. 9. When SWA is at an H level, for example, the switch SA is connected to the +Vs side, and when it is at an L level, the switch SA is connected to the −Vs side. Symbols VDX, VSX, VMX, VA and VB represent the potentials or potential difference at the points shown in FIG. 9. In FIGS. 10 to 12, the relationship (N−M)>>M is established, to thus provide a condition whereby the influence due to the dullness of the waveform is noticeable, and values approximate to those of an actual display device are selected for ro, c, RD, RS and RM. Although the value c changes between the ON time and the OFF time in a practical liquid crystal, it is here assumed that the value c does not change in accordance with the state, for the purpose of simulation.

FIG. 10 shows the simulation results of the case that corresponds to FIG. 6. In FIG. 10, symbols VY1, VY2 and VY3 represent the selection timing of the common electrodes and this diagram shows the state where the selection potential (+Vc or −Vc) is applied to the respective common electrodes at the hatched portions while the zero (0) potential is applied thereto during the other periods. As these merely represent the timing, they are neglected during the simulation.

The state SWA of the switch SA described above changes to H and L whenever the selection period of the common electrodes changes, as shown in the diagram, because the A group described above must display only white or only black throughout the full row and the state SWB of the switch SB is fixed to H during one vertical scanning period, for example (to L during the next scanning period), because the B group should display each row alternately as white and black.

The waveforms of VA and VB in FIG. 9 at this time are ideally shown by VA and VB in FIG. 10, but in practice, these become VAX and VBX as shown in FIG. 10. Nevertheless, although the dullness of the waveform and spikes exhibit exponential changes in practice, they are expressed linearly for simplification. Furthermore, it is believed that the spike for an extremely short period can be neglected when calculating the effective value from the response of the liquid crystal, and thus this is omitted from the drawing (this also holds true for the subsequent drawings).

When VAX, VBX are compared with FIG. 6, it can be understood that VAX exhibits a similar tendency but VBX is apparently different. This is because VDX, VSX and VMX change as shown in FIG. 10, due to the presence of the resistors RD, RS and RM shown in FIG. 9. Next, this change will be explained. When the switch state SWA changes from L to H at the time Tp, a spike-like current flows from +Vs in FIG. 9 towards the zero (0) potential through the path ranging from the resistor RD, the switch SA, the resistor rA, the capacitance CA and the resistor RM, and the voltage drop due to this current changes VDX and VMX in the spike form. At this time, the current does not flow through the resistor RS, and VSX does not change. Next, when the switch state SWA changes from H to L at the time Tq, a spike-like current flows from the zero (0) potential towards −Vs through the path ranging from the resistor RM, the capacitor CA, the resistor rA and the resistor RS, so that VSX and VMX change. At this time, the current does not flow through the resistor RD, and VDX does not change.

If the value N−M is sufficiently high, the rA becomes sufficiently low. Therefore, the voltage drop due to the resistor rA is sufficiently smaller than the voltage drop due to the resistors RD, RS. On the other hand, the current flows through the capacitance CB with the change of VDX, VMX, but if M is sufficiently smaller than N−M, the value cB is sufficiently smaller than cA and the voltage drop component of the current flowing through cB due to the resistor rB becomes relatively very small. Namely, the voltage VAX (or VBX) across both ends of the liquid crystal is substantially VDX−VMX when the switch state SWA (or SWB) is at H and is substantially VSX−VMX when the switch state SWA (or SWB) is at L, as shown in FIG. 10.

In the vicinity of the time Tp, the changes of VDX and VDM act in a direction which reduces the effective values of both the VAX and VBX, but in the vicinity of the time Tq, the change of VAX acts in a direction that reduces the effective value for VBX and the changes of both VMX and VSX act in a direction that reduces the effective value for VAX. Accordingly, it is believed that the difference between VAX and VBX is affected more by the resistors RD, RS, RM than by the segment electrode output resistance ro in FIG. 8.

FIG. 11 shows the results of a simulation when the A and B groups described above effect white and black opposite displays throughout all the rows, and FIG. 12 shows the results of a simulation when the A group effects the white or black display but the B group effects a gray display between white and black. In these drawings, the symbols and names have the same meaning as in FIG. 10. The difference of these drawings from FIG. 10 is that the current resulting from the change of SWB flows through CB in FIG. 9, but this current component may be neglected because the value of CB is sufficiently smaller than the value of CA, as already described. Accordingly, the same concept as in FIG. 10 can be applied to FIGS. 11 and 12. Although an individual explanation thereof is omitted, it is obvious from these results that the driving effective voltage applied to the pixels of the A group drops at the time of a non-selection and the driving effective voltage applied to the pixels of the B group rises more than those of the A group at the time of a non-selection. Since the liquid crystal is assumed to be normally back, the display state becomes darker when the driving effective voltage drops and becomes brighter when the driving effective voltage increases. Therefore, the display state of a certain pixel in the A group becomes darker than its original display state, and the display state of a certain pixel in the B group becomes relatively brighter (brighter than the original display state in the cases of FIGS. 11 and 12, in particular). When the differences between the driving voltages VAX and VBX applied to the pixels of the A and B groups during the non-selection period are compared with one another for FIGS. 10, 11 and 12, it can be understood that the difference exists only near the time Tq in the case of FIG. 10, but the differences exist both near the time Tp and the time Tq in the cases of FIGS. 11 and 12. Naturally, the difference occurs in those rows in which the display state of the B group is different from the display state of the A group, and the difference of the driving effective voltage throughout the non-selection period is determined by the number of such rows.

The explanation given above deals with the non-selection period, and the situation becomes more complicated in the case of the selection period, as follows. If the dullness of the waveform of the selection voltage (±Vc) is neglected, the A group gives a white display in FIG. 10, for example, the common electrode drive voltage VY1 should be −Vc at the time Tp, and therefore, −Vc−VDX is applied to the pixels of the Y1 row of the A group. Since the common electrode drive voltage VY2 should be +Vc at the time Tq, +Vc−VSX is applied to the pixels of the Y2 row of the A group. Obviously, the direction of the dullness of VDX, VSX in this case is the direction which reduces the effective value in the selection period (the direction which darkens the white). Conversely, when the A group effects the black display, the common electrode drive electrode VY1 at the time Tp should be +Vc. Therefore, +Vc−VDX is applied to the pixels of the Y1 row of the A group. Since the common electrode drive voltage VY2 should be −Vc at the times Tq, −Vc−VSX is applied to the pixels of the Y2 row of the A group. In this case, it is obvious that the direction of the dullness of VDX and VSX is the direction which increases the effective value in the selection period (the direction which brightens black). It can be assumed from the above discussion that the dullness of the drive voltage applied to the pixels of the A group during the selection period acts in such a direction as to lower the contrast. For the pixels of the B group, the same voltage as the voltage of the A group is applied to the pixels of the B group having the same display as the A group, but for the display pixels different from those of the A group, +Vc−VDX is applied at the time Tq when the A group effects the white display, for example, and the effective value during the selection period is not altered.

To summarize the above discussion, if N−M>>M in the example shown in FIG. 9, the following can be concluded.

(1) During the non-selection period, the driving effective voltage drops regardless of the display state in the A group. The degree of the voltage drop depends on the number of times of switching of the segment electrode voltage.

(2) During the non-selection period, the driving effective voltage increases more in the B group than in the A group regardless of the display state. The degree of this increase depends on the number of rows having a different display state from the A group at the time of switching of the segment electrode drive voltage of the A group.

(3) During the selection period, the driving effective voltage drops in the A group when the display state changes from black to white. The driving effective voltage increases when the display state changes from white to black.

(4) During the selection period, the driving effective voltage either increases, decreases or does not change in the B group, depending on the display state.

The driving effective voltage practically applied to the liquid crystal must be calculated throughout the selection period as well as throughout the non-selection period. Strictly speaking, therefore, an extremely complicated calculation must be made, depending on the display state. Therefore, it is assumed that the influences of the resistors RD, RS and RM are great as the cause of the cross-talk or the drop of the contrast. Accordingly, it must be concluded that the conventional concept is not sufficient, and thus really effective counter-measures cannot be taken.

FIGS. 11 and 12 show the results of a simulation wherein all the columns (N columns) of the liquid crystal display device are divided into two column groups (A group and B group) and the number N–M of the columns of the A group is made sufficiently greater than the number M of the columns of the B group, and FIG. 13 shows the results of a simulation where the number of the columns of the A group is the same as that of the B group. The timing relation in FIG. 13 corresponds to that of FIG. 11. Although the difference of the effective value between VSX and VBX is clearly observed in FIG. 11, the difference of the effective value between VAX and VBX is not observed in FIG. 13. Namely, although cross-talk does not occur in this case, it is important to note that the dullness of the waveform at each part in FIG. 13 is smaller than that in FIG. 11. As already described, the effective value at the time of selection is affected by the dullness of the waveforms of VDX and VSX. Since the dullness of VDX and VSX is great in the case of FIG. 11, the deviation of the driving voltage applied to the pixels during the selection period from the theoretical value is great, and the tendency for the white portion to become dark and the black portion to become bright is strong, so that the contrast drops even when the effective value during the non-selection period is the same. In the case of FIG. 13, however, the dullness of VDX, VSX is small and the drop of the contrast is also small. Paradoxically, the maximum contrast can be obtained by displaying half of the screen in white and the other half in black; if the screen is displayed as fully white or black and the difference between these cases is considered, the lowest contrast can be obtained.

The cause of the difference of the dullness of the waveform between FIGS. 11 and 13 can be understood to be as follows. FIG. 14(A) is an equivalent circuit diagram when the case of FIG. 13 is used as an example is assumed that the capacitance of the liquid crystal formed by the half of the screen is cx and RD, RS and RM are all rx, for a simplification. At this time, the current Ix flowering from +Vs flows to −Vs and the current does not flow towards the zero (0) potential. The time constant Tx of the circuit at this time is $(2\cdot rx)\ (cx/2)=rx\ cx$, and the dullness of the waveform of the voltage applied across both ends of the liquid crystal of the A group is small, as shown in FIG. 14(B).

Further, FIG. 15(A) is an equivalent circuit diagram corresponding to FIG. 11. Assuming that the capacitance of the B group is much smaller than that of the A group, the capacitance of the A group can be set to $2\cdot(cx)$ by regarding the capacitance of the B group as zero (0). At this time, the current flowing from +Vx flows fully towards the zero (0) potential. The time constant Tx of the circuit at this time is $(2\cdot rx)\cdot(2\cdot cx)=4\cdot rx\cdot cx$, and the dullness of the waveform of the voltage applied across both ends of the liquid crystal of the A group becomes four times as great as that of FIG. 14, as shown in FIG. 15(B). This difference of the time constants means that the difference of four times also exists between the maximum and minimum dullness of the waveforms of VDX and VSX.

Assuming that the effective value at the time of non-selection is equal, the difference of the display state is determined by the difference of the effective values at the time of selection, and since the effective value at the time of selection is affected by the dullness of the waveforms of VDX, VSX, the difference of the dullness of the waveforms VDX, VSX at the time of selection means the difference of the effective value at the time of selection. Accordingly, the portion which should originally have the same brightness becomes different depending on the display state. When the effective values are calculated, the difference of four times of the time constants is a value greater than four times.

A counter-measure for the cross-talk which takes the resistance of the power supply lines into consideration has been very recently proposed ("SID 90 DIGEST, 412.21: "Crosstalk-Free Drive Method for STN-LCDs" (hereinafter referred to as the "Reference 2")). FIG. 3 of this reference depicts the resistor corresponding to RM of the present invention, and the Reference 1 ascribes the voltage drop due to this resistor as one of the causes of the cross-talk. To correct the influences of this voltage drop, the Reference 1 adds a D.C. bias voltage ΔV to VM, which is defined in the present invention, in each drive period of each row. The Reference 1 describes that the ΔV at this time can be calculated from the difference between the number of pixels in the ON state on the common electrodes which are now in the selection period, and the number of pixels which are to be turned ON, on the common electrodes which are to be selected next.

To state the conclusion first, this method is effective as a counter-measure for the cross-talk, but this example does not fully consider the power supply resistors RD, RS in the present invention. Since the Reference 2 is based on the concept that the difference of the effective voltage during the non-selection period is offset by the D.C. bias, the value ΔV described above is relatively small and the dullness of the waveform does not change much. This means that, although the effective voltage during the non-selection period can be made uniform, the influence of the dullness of the waveform during the selection period is not greatly improved and the cause of the cross-talk remains. In connection with the contrast and response also, improvements are yet to be made as long as the influences of RD and RS exist. As described in the Reference 2, this method is effective for a "frame gradation", but cannot be applied so easily to those devices which effect a gradation display by changing the voltage impression time during the selection period, as in a liquid crystal television receiver.

The value ΔV described above is calculated from the difference of the number of the pixels in the ON state on the common electrodes that are currently in the selection period, and the number of the pixels, which are to be turned ON, on the common electrodes which are to be selected next. Nevertheless, even though the number of the pixels turned ON during a certain selection period is the same, the timing at which the pixels are turned ON is not always the same. In other words, there is the case where all the pixels are simultaneously turned ON, and there is also another case where the pixels are turned ON individually or non-uniformly. Since the effective values turn out different in both of these cases, a correction cannot be made. Since the capacitance of the liquid crystal changes with the drive state, as already described, the capacitance value, or the current value and thus the power supply voltage change, changes in a complicated manner under a complicated drive state such as in the case of the gradation display, and it is extremely difficult to maintain a predetermined correction state. The change of the ambient temperature also must be taken into consideration when solving this problem.

SUMMARY OF THE INVENTION

Therefore, an object of the present invention is to solve the problems resulting from the dullness of the waveform, inclusive of the problem of the cross-talk described above, in all display modes by bringing the drive voltage applied to both ends of the liquid crystal as close as possible to an ideal state.

The influences of the resistance of each part (the output resistance of the power supply, the wiring resistance inside the drive integrated circuit, the wiring resistance inside the panel, etc.) that result in the dullness of the waveform are the influences of the voltage drop brought forth by the current that flows through the resistance of each part. This current flows into and out of the common electrode drive circuit and the segment electrode drive circuit through the liquid crystal, which is a capacitive load, and leads to the voltage drop when it flows through the resistance of each part, so that a voltage different from the external voltage given is eventually applied to the liquid crystal. The present invention is based on the premise that the voltage drop always exists, regardless of the degree thereof, pays specific attention to the resistance that exists parasitically in the power supply system and exerts a particularly great influence, detects the current that brings such a voltage drop to the resistance, and changes the external voltage to be given to the drive circuit in accordance with this current quantity, to thus solve the problem described above.

FIG. 16 is an explanatory view explaining the fundamental concept of the present invention. When the circuit shown in FIG. 16(A) is considered and the voltage waveform to be applied to the point V and the voltage waveform at the point E corresponding to the former are considered, the dullness of the waveform at the point E is great as shown in FIG. 16(B) if a step-like voltage waveform is applied to V, but is small if an impulse-like correction voltage is added to the voltage to be applied to the point V as shown in FIG. 16(C). The means for solving the problems, employed in the present invention on the basis of such a concept, comprises the following. Namely, in a display device including a display panel having common electrode groups and segment electrode groups, a common electrode driving circuit and a segment electrode driving circuit, the present invention detects a current quantity flowing through the display panel, and is constituted such that:

(1) the common electrode drive voltage applied to the common electrode group through the common electrode drive circuit is adjusted in accordance with the current value; and (2) the segment electrode drive voltage applied to the segment electrode group through the segment electrode drive circuit is adjusted in accordance with the current value.

In accordance with the present invention, the voltage drop induced by the current flowing through the display panel is adjusted by detecting this current, so that the driving voltage applied to the liquid crystal approaches the ideal state in all conditions, whereby the contrast and response are improved and cross-talk is greatly reduced.

DESCRIPTION OF THE PREFERRED EMBODIMENTS

An electrooptical display device of the present invention basically has a technical construction such that the electrooptical display device comprises a display panel having common electrode group and segment electrode group, a display device having a common electrode driving circuit and a segment electrode driving circuit and an adjusting circuit provided with a current detection means for detecting current flown through said display panel and a voltage control means for controlling a driving voltage applied to both terminals of the display device and which is provided between a driving power source of said display device and said display device wherein said adjusting circuit operates so that said voltage control means is operated in response to an output signal output from said current detection means to correctly adjust a deformation of a wave-form of a driving voltage applied to both terminals of said display panel.

Figure 23:
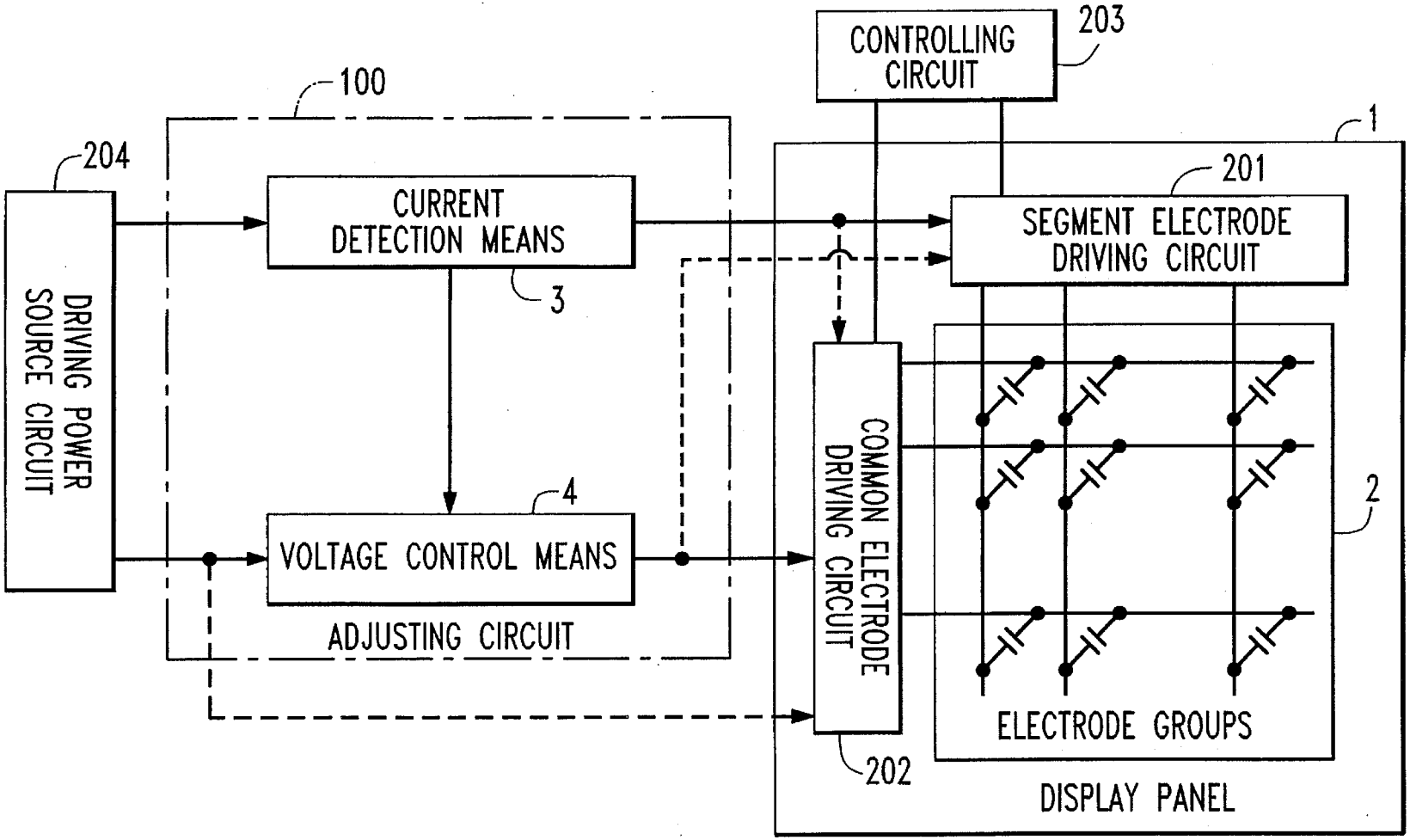
FIGS. 23 to 28 are views illustrating a first to a sixth aspects of the present invention, respectively.
Figure 24:
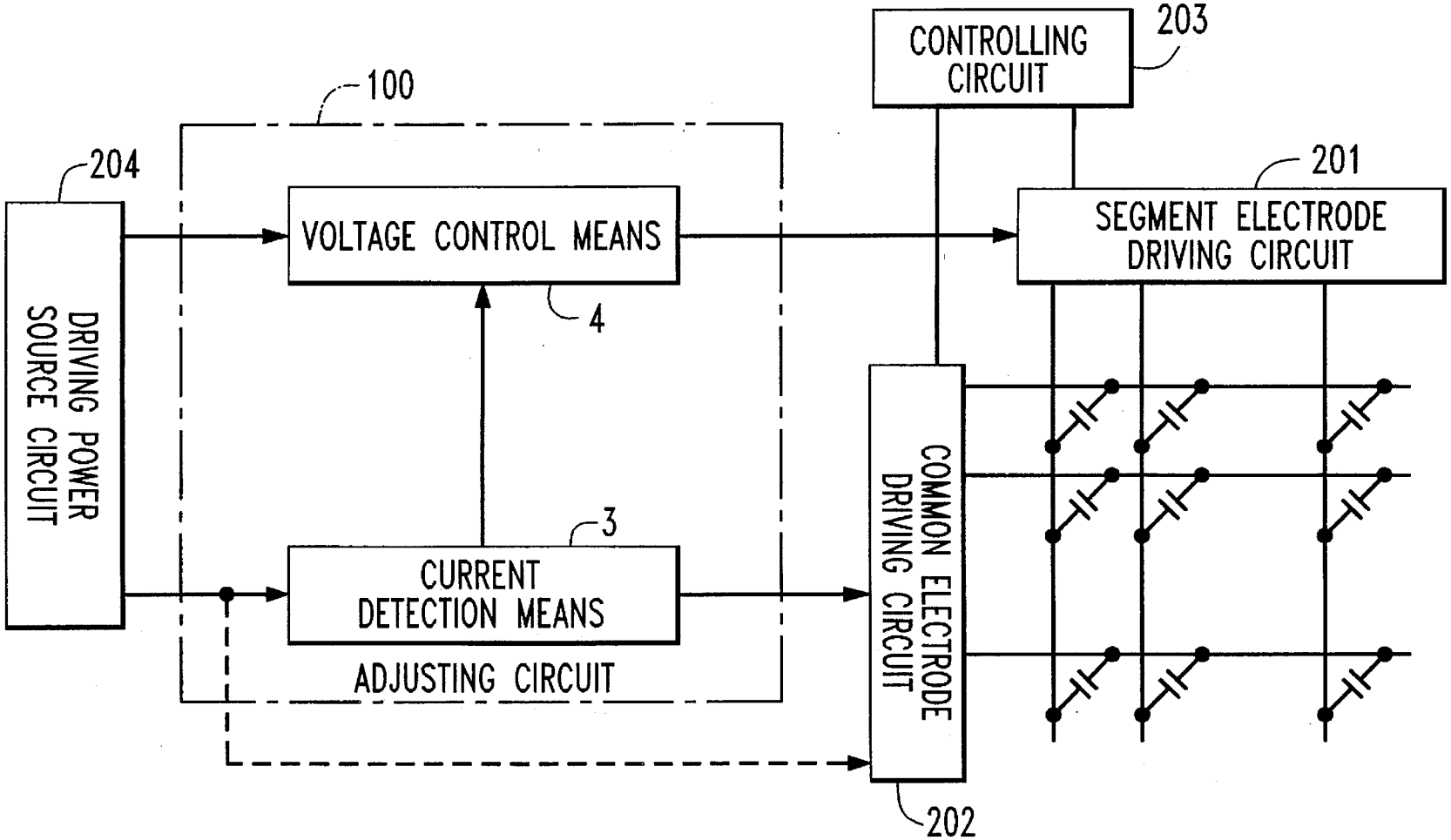

In accordance with a first aspect of the present invention, the electrooptical display device is constructed as shown in FIGS. 23 and 24, in which a current detection means of an adjusting circuit is connected any one of said common electrode driving circuit and a segment electrode driving circuit, while a voltage control means thereof is connected to an opposite electrode driving circuit to which the common electrode driving circuit connects.

Figure 27:
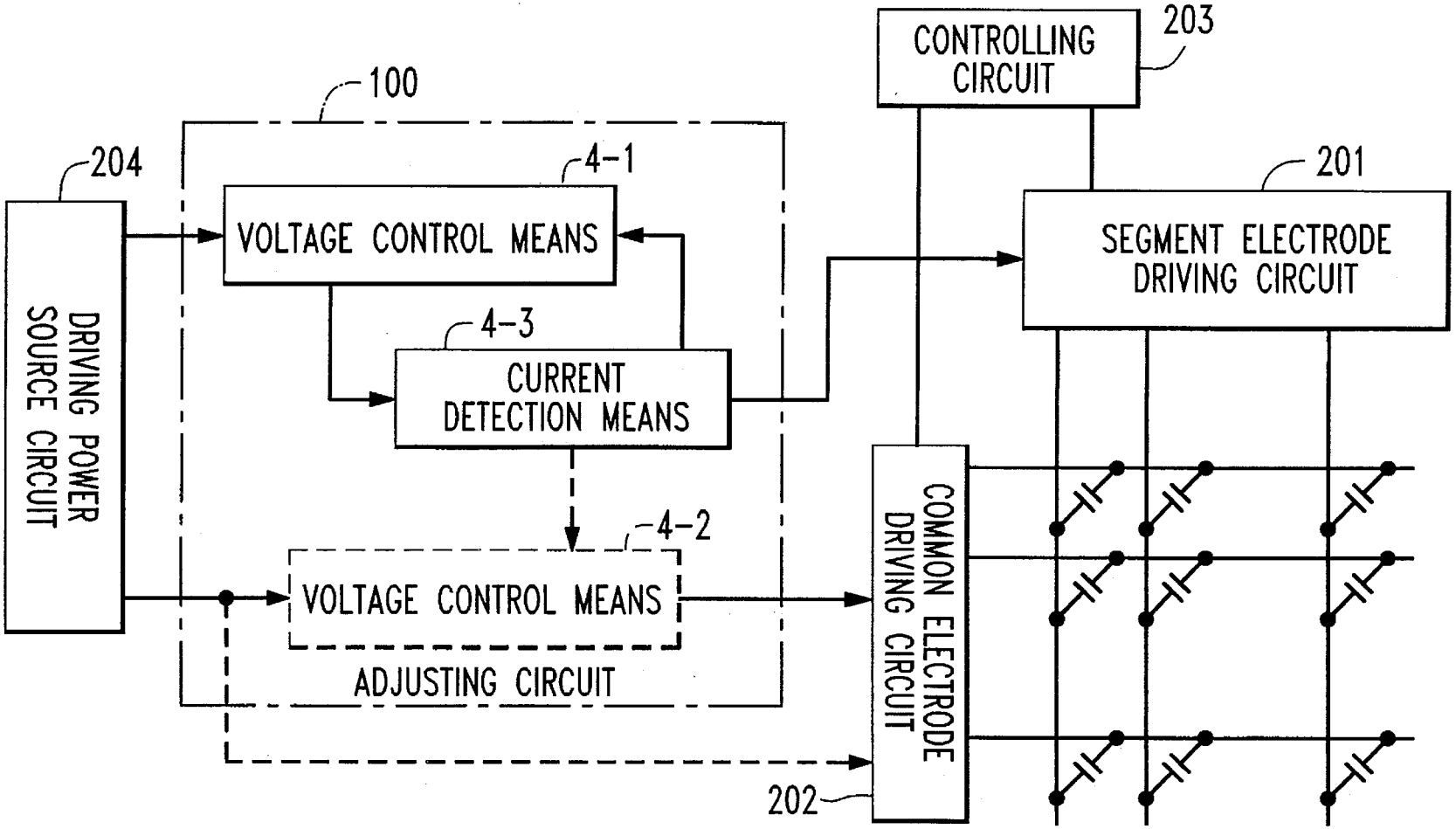
Figure 28:
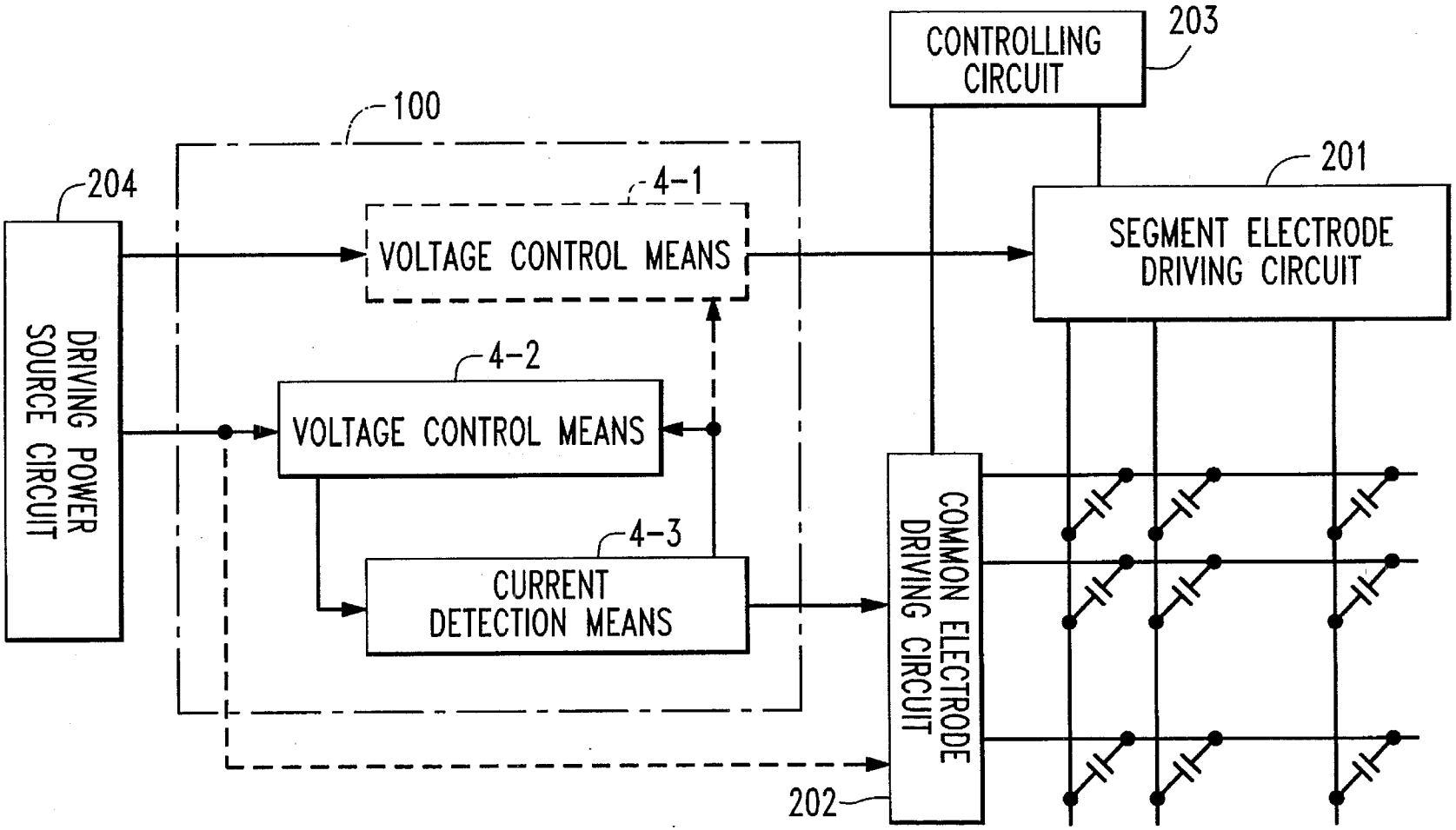

In accordance with a second aspect of the present invention, the electrooptical display device is constructed as shown in FIGS. 27 and 28 in which a current detection means of the adjusting circuit is connected any one of the common electrode driving circuit and the segment electrode driving circuit, while the voltage control means thereof is connected to the same electrode driving circuit to which the common electrode driving circuit connects.

In accordance with a third aspect of the present invention, the electrooptical display device is constructed in which a current detection means and the voltage control means of the adjusting circuit are connected both of the common electrode driving circuit and the segment electrode driving circuit.

In accordance with a fourth aspect of the present invention, the electrooptical display device is constructed as shown in FIG. 27 or 28, in which a current detection means of the adjusting circuit is connected any one of the common electrode driving circuit and the segment electrode driving circuit, while the voltage control means thereof is connected to both of the common electrode driving circuit and the segment electrode driving circuit.

Figure 26:
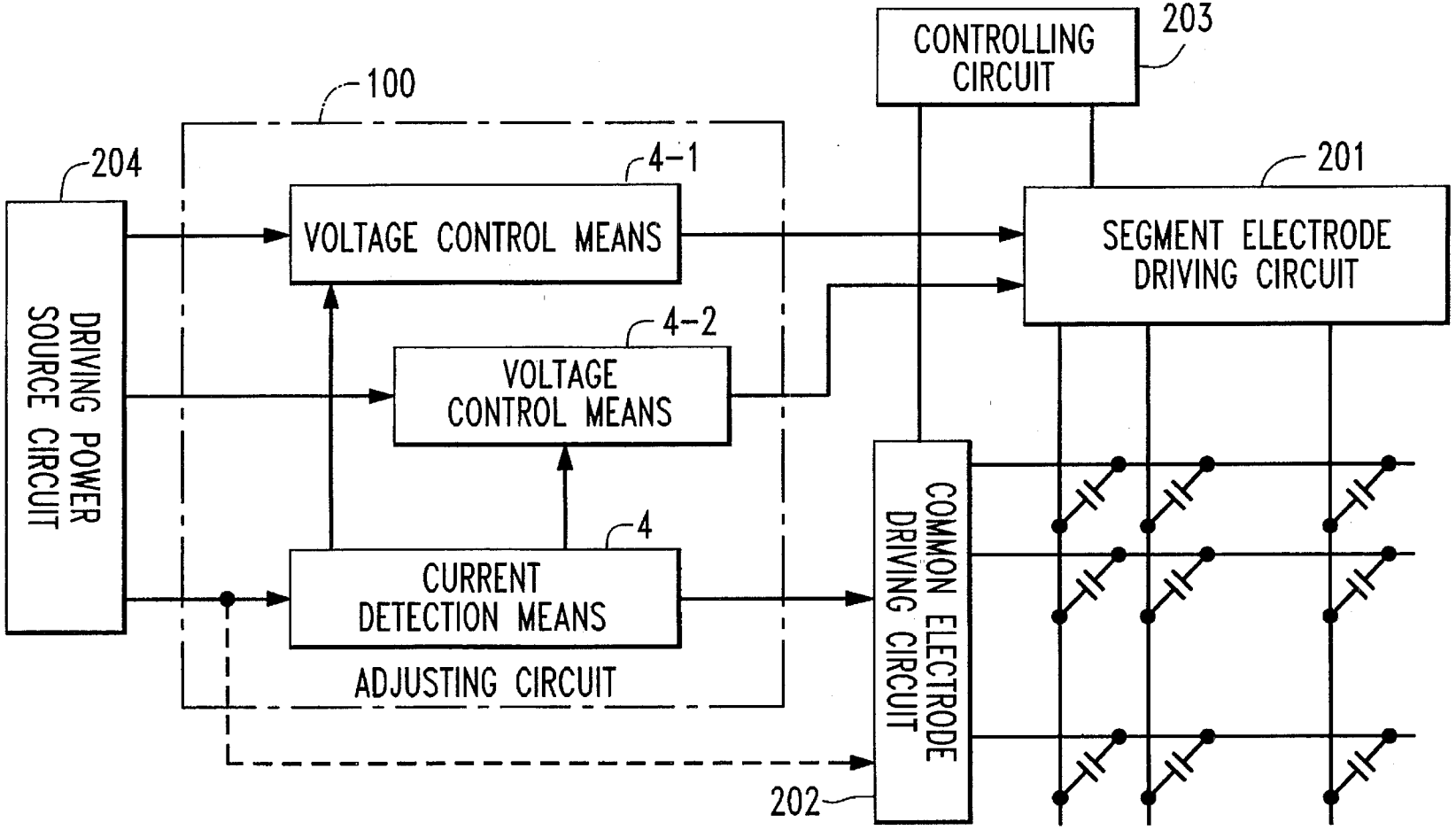

In accordance with a fifth aspect of the present invention, the electrooptical display device is constructed as shown in FIG. 26, in which a current detection means is connected to the common electrode driving circuit and a plurality of segment electrode driving voltage control means are connected to said segment electrode driving circuit and to a plurality of said segment electrode driving voltage sources, wherein each one of said segment electrode driving voltage control means is controlled by an output signal output from said current detection means.

Figure 25:
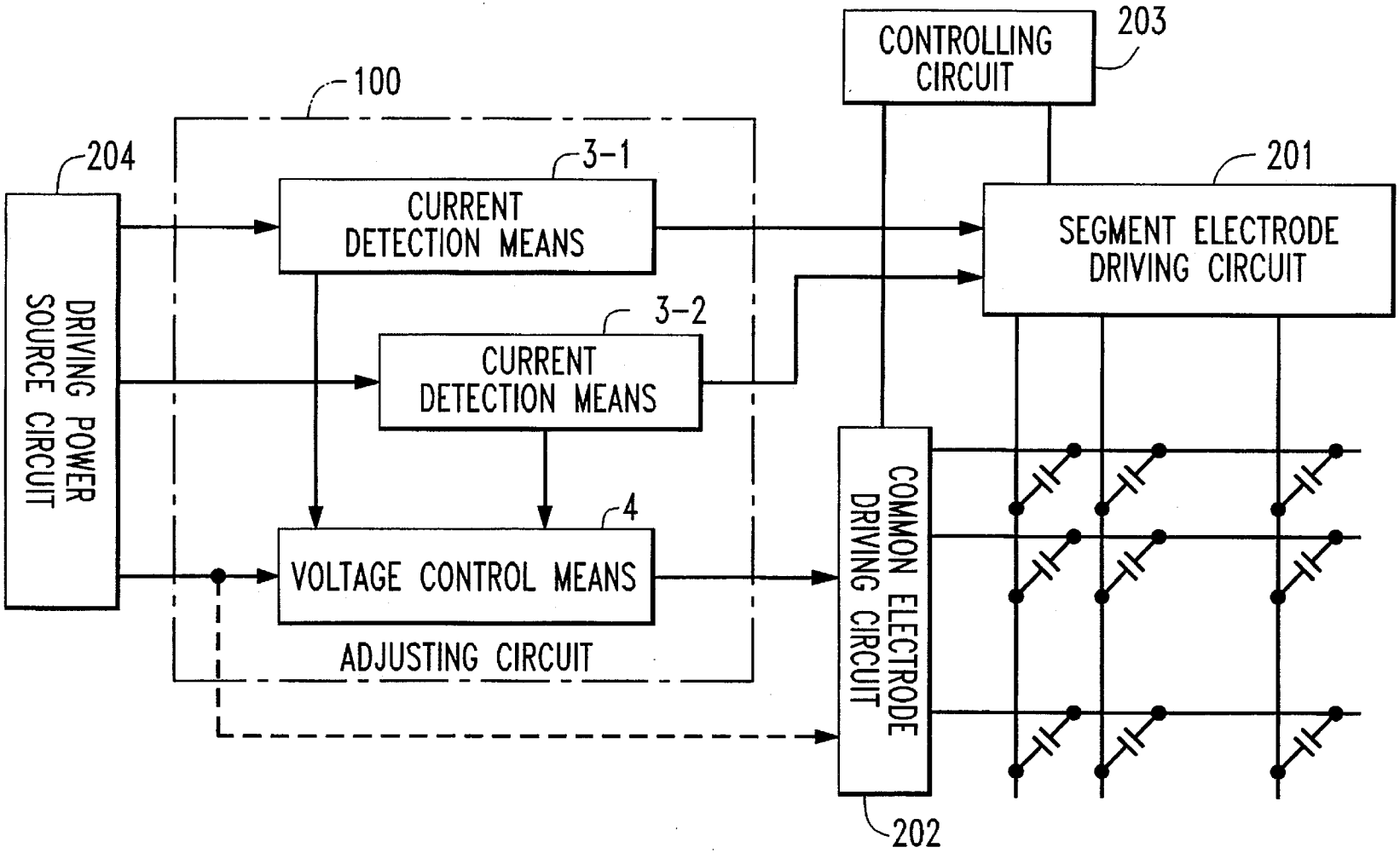

In accordance with a sixth aspect of the present invention, the electrooptical display device is constructed as shown in FIG. 25, in which a voltage control means is connected to the common electrode driving circuit and a plurality of segment electrode driving current detection means are connected to the segment electrode driving circuit and to a plurality of the segment electrode driving voltage sources, wherein the common electrode voltage control means is controlled by each one of output signal output from the each one of the current detection means.

In accordance with a seventh aspect of the present invention, the electrooptical display device is constructed as shown in FIGS. 27 and 28, in which both of the current detection means and a fist voltage control means of the adjusting circuit are connected to any one of the common electrode driving circuit and segment electrode driving circuit and the adjusting circuit is further provided with a second voltage control means separate from the first voltage control means which is connected to an opposite electrode driving circuit to which the first voltage control means connects.

The preferred embodiments of the present invention will be explained with reference to Figures with respect to each one of the aspects of the present invention as mentioned above.

Figure 1:
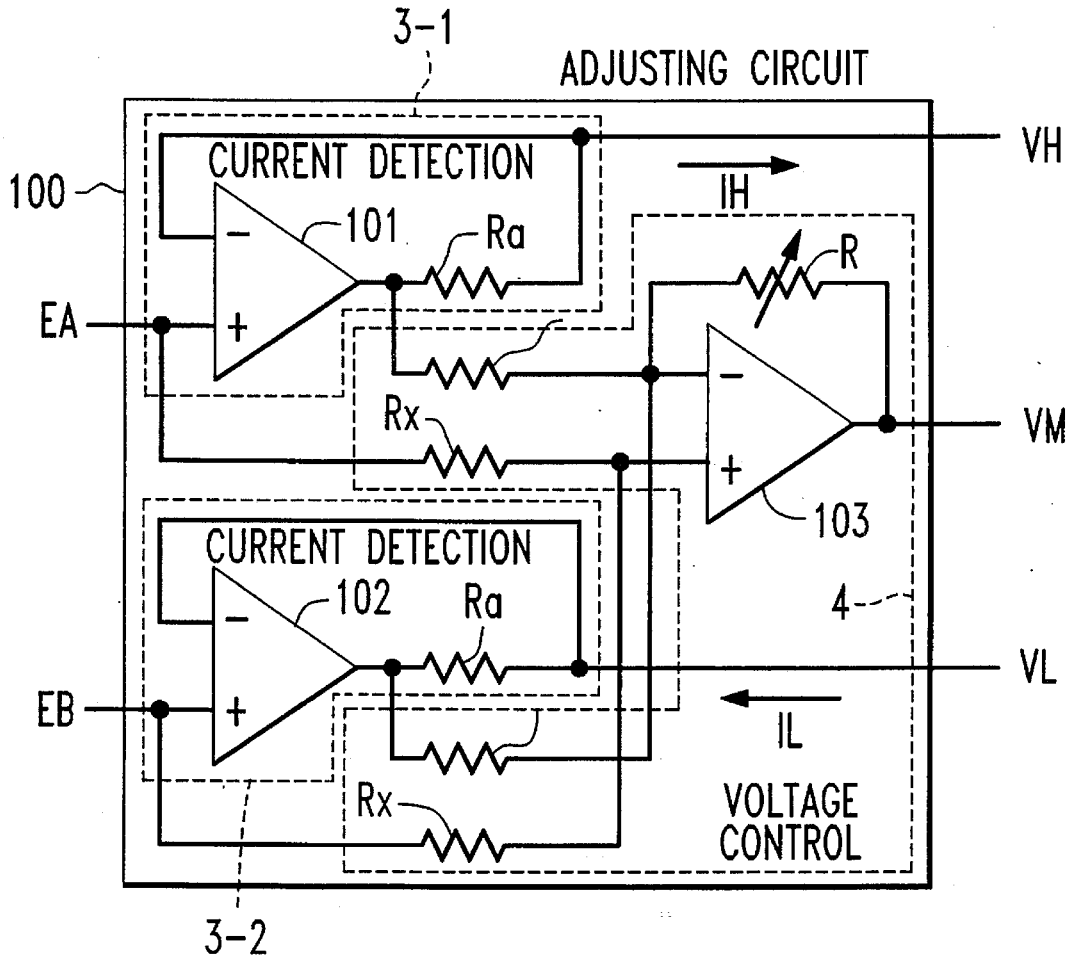
FIG. 1 is a structural circuit view showing a first embodiment of the present invention.

FIG. 1 shows the first embodiment of the present invention, and corresponds to a first aspect of the present invention as shown in FIG. 23 or 25. In FIG. 1, a correction circuit 100 is constituted as follows. A potential EA is applied to the positive input terminal of a first differential amplifier 101 and the output terminal of this first differential amplifier 101 is fed back to the negative input terminal of the first differential amplifier 101 through a resistor Ra, and is connected to the negative input terminal of a third differential amplifier 103 through a resistor r. A potential EB is applied to the positive input terminal of a second differential amplifier 102 and the output terminal of this second differential amplifier 102 is fed back to the negative input terminal of the second differential amplifier 102 and is connected to the negative input terminal of the third differential amplifier 103 described above. The potential EA is applied to the positive input terminal of the third differential amplifier 103 through a resistor Rx and the potential EB is applied thereto through the resistor Rx. The output terminal of this third differential amplifier 103 is fed back to the negative input terminal of the third differential amplifier 103 through the resistor R. The output VH is taken out from the negative input terminal of the first differential amplifier 101, the output VL, from the negative input terminal of the second differential amplifier 102 and the output VM, from the output terminal of the third differential amplifier 103.

Note that, in the first embodiment, two current detection means 3-1, and 3-2, and a voltage control means 4 are provided in the adjusting circuit 100.

Figure 17:
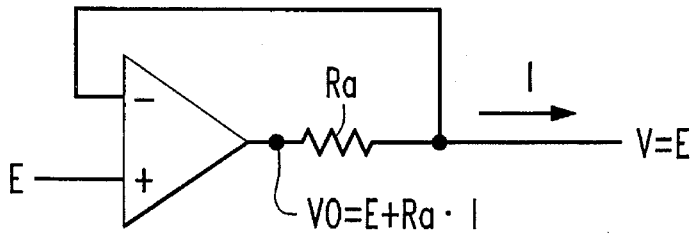
FIGS. 17 and 18 are explanatory views of embodiments of a current detection means and a voltage control means.

This circuit will be explained with reference to FIGS. 17 and 18. The circuit shown in FIG. 17 is a well known current detection circuit. Assuming that the current flowing from the output V to a load is I, the following relationship can be established;

$$V=E,\ Vo=E+Ra\cdot I$$

Figure 18:
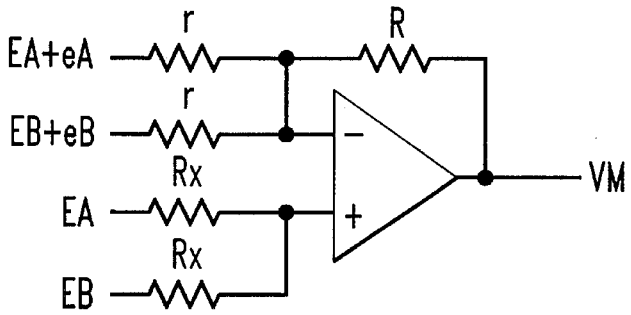

The output VM in the circuit shown in FIG. 18 is given as follows:

$$VM=(EA+EB)/2-(R/r)\cdot(eA+eB)$$

Therefore, assuming that the current flowing out of the output VH is IH and the current flowing into the output VL is IL in the circuit shown in FIG. 1, the following relationship can be established:

$$VH=EA,\ VL=EB,$$

$$VM=(EA+EB)/2-(R\cdot Ra/r)\cdot(IH-IL)$$

Accordingly, VM takes the value obtained by subtracting the voltage proportional to IH from the intermediate voltage between EA and EB, and adding the voltage proportional to IL to the balance.

Figure 9:
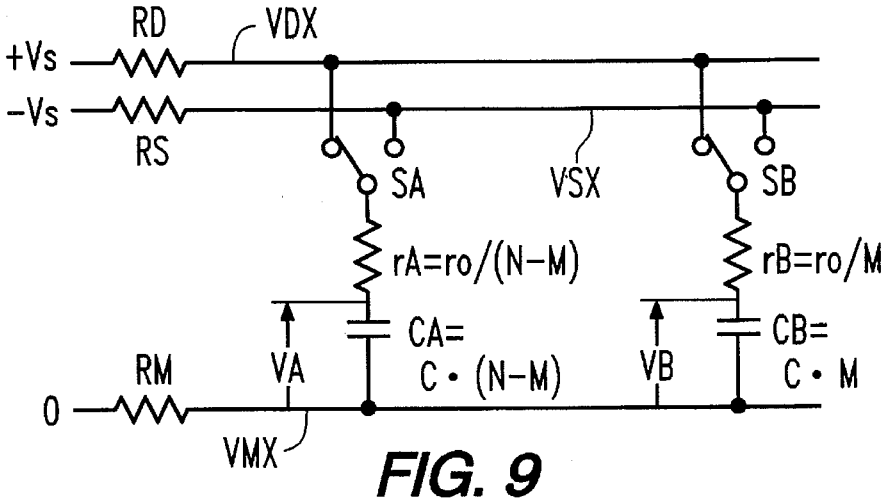
FIG. 9 shows a second model of the liquid crystal drive system fabricated according to the present invention.
Figure 19:
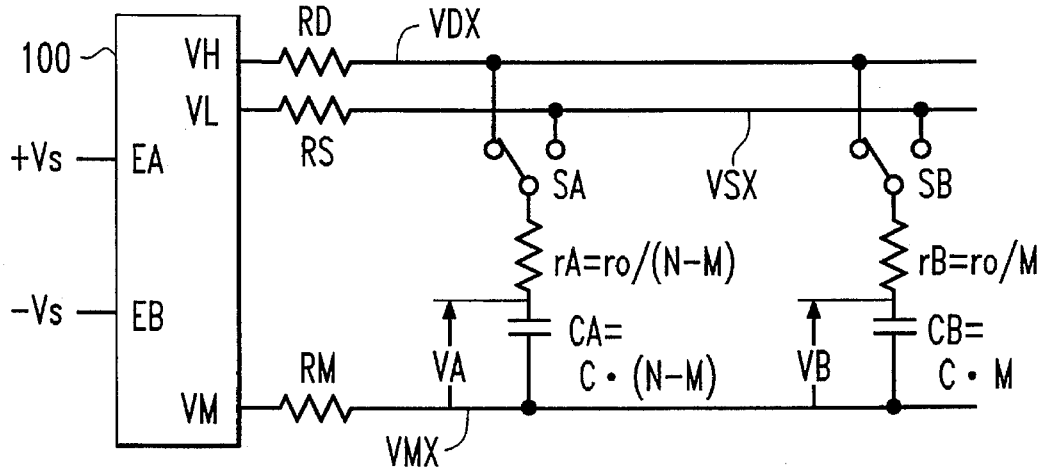
FIG. 19 is a structural view showing the first embodiment of the present invention applied to the liquid crystal drive system model shown in FIG. 9.

When the adjusting circuit 100 shown in FIG. 1 is applied to FIG. 9, the circuit structure becomes as shown in FIG. 19, i.e., if EA=+Vs and EB=−Vs, then, $$VH=+Vs,\ VL=-Vs,$$

$$VM=-(R\cdot Ra/r)\cdot(IH-IL)$$

Therefore, when IH flows and VMX rises, VM drops in proportion to IH and lowers VMX. If IL flows and VMX drops, VM rises in proportion to IL and raises VMX. The proportional constants to be applied to IH and IL are regulated by making R variable.

Figure 10:
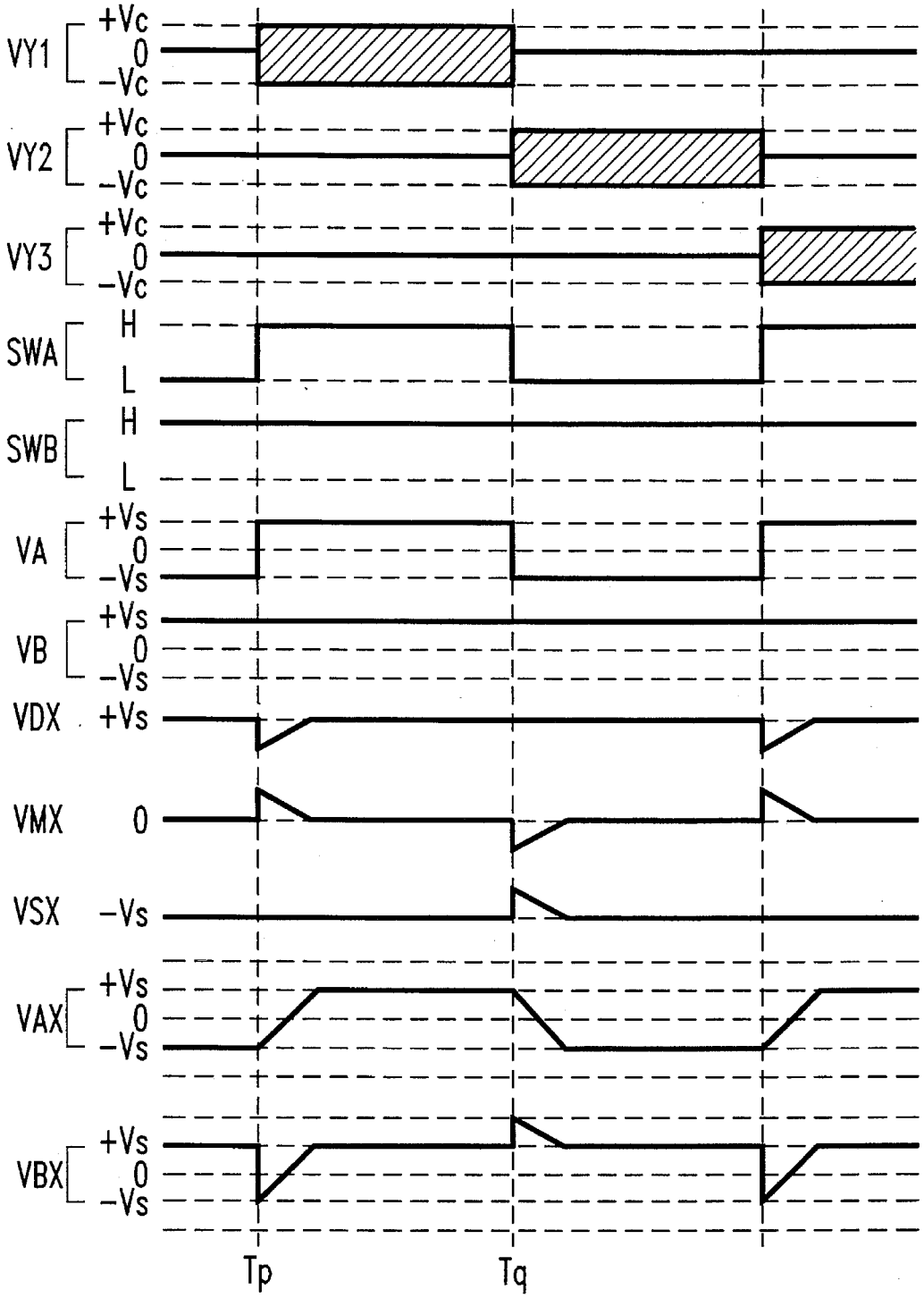
FIGS. 10 to 13 are explanatory views of the present unsolved problems, on the basis of the results of a simulation of the second model.
Figure 11:
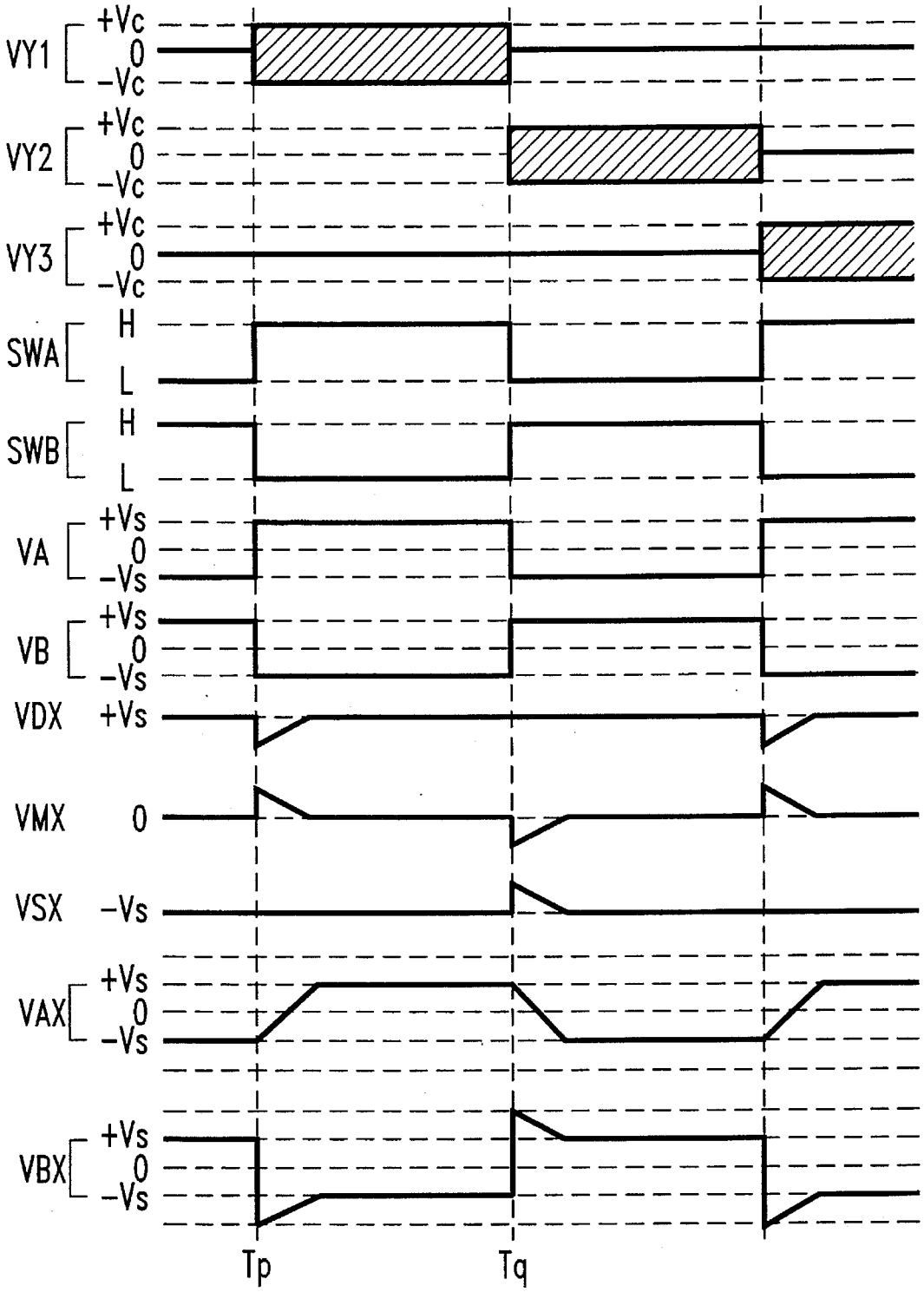
Figure 12:
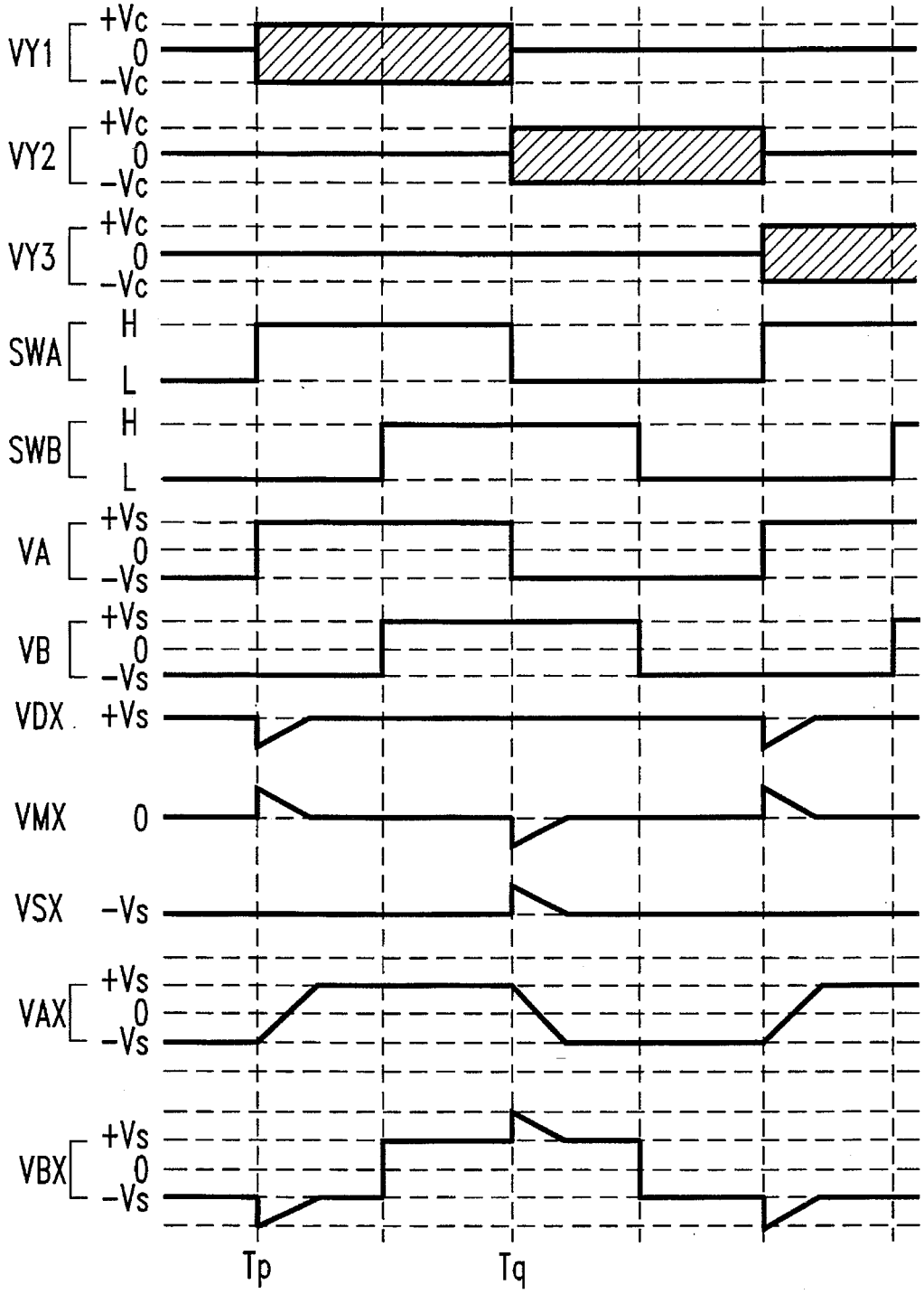
Figure 13:
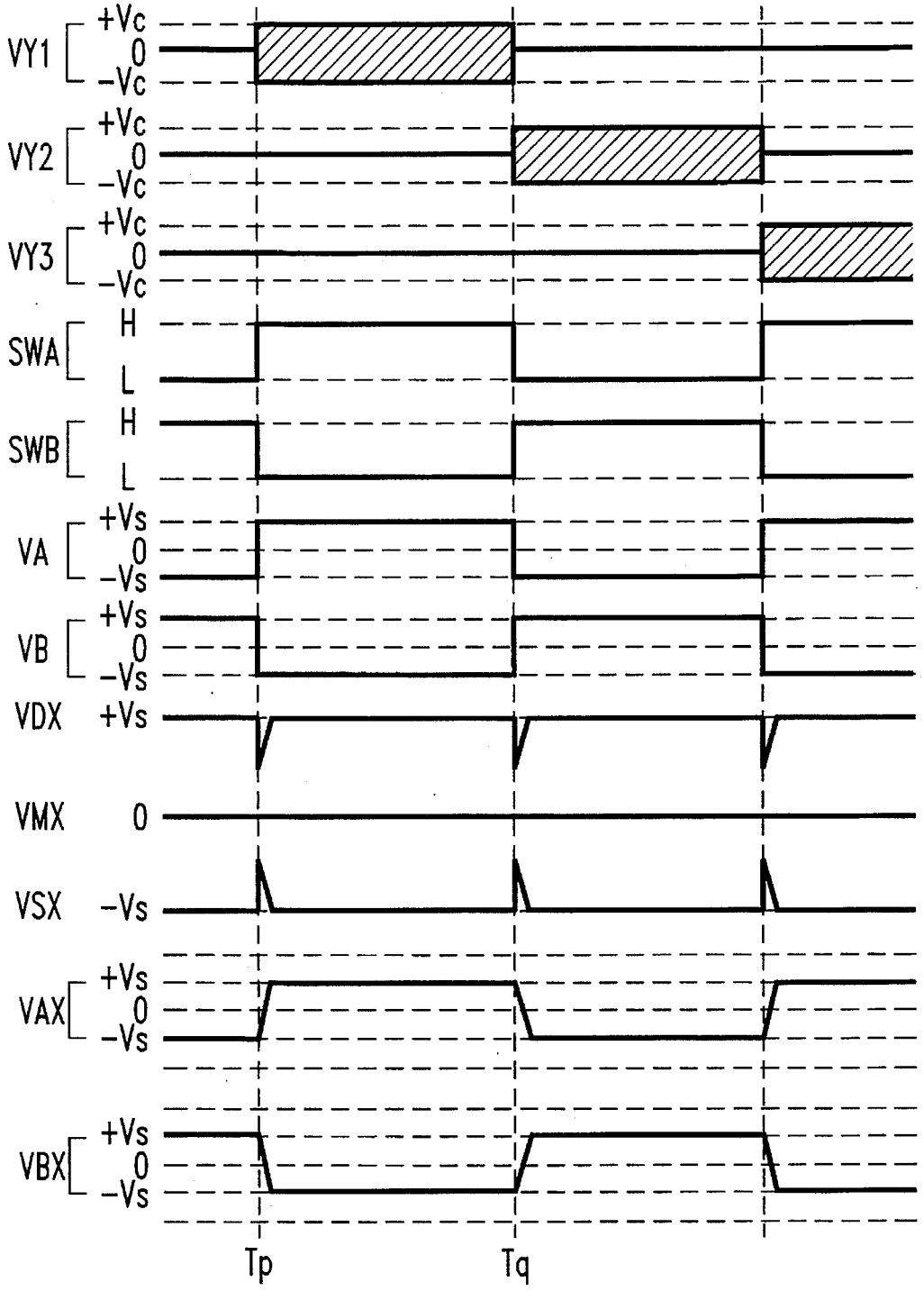
Figure 20:
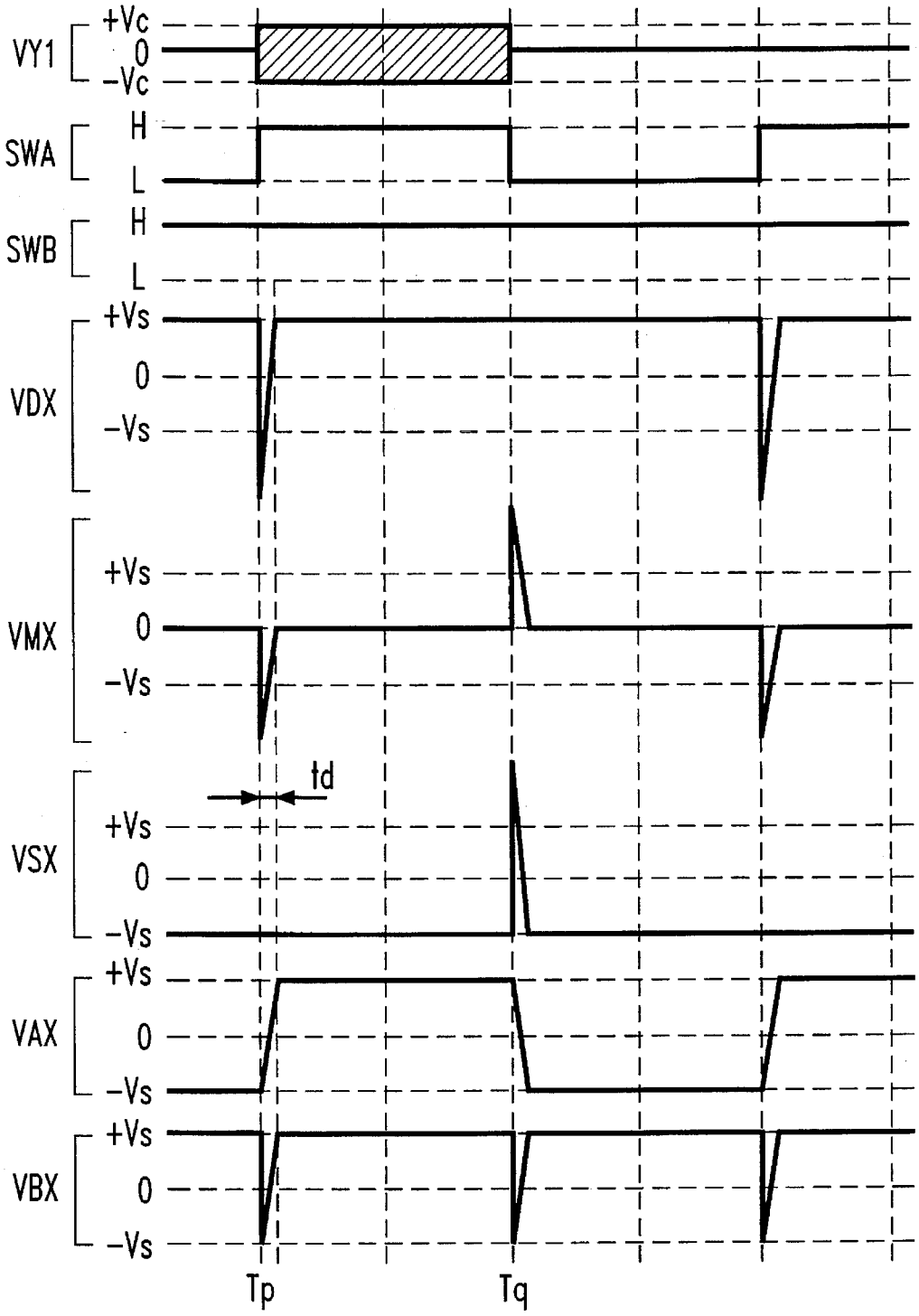
FIGS. 20 to 22 are explanatory views of the effects of the present invention, on the basis of results obtained by simulating the structure shown in FIG. 19.
Figure 21:
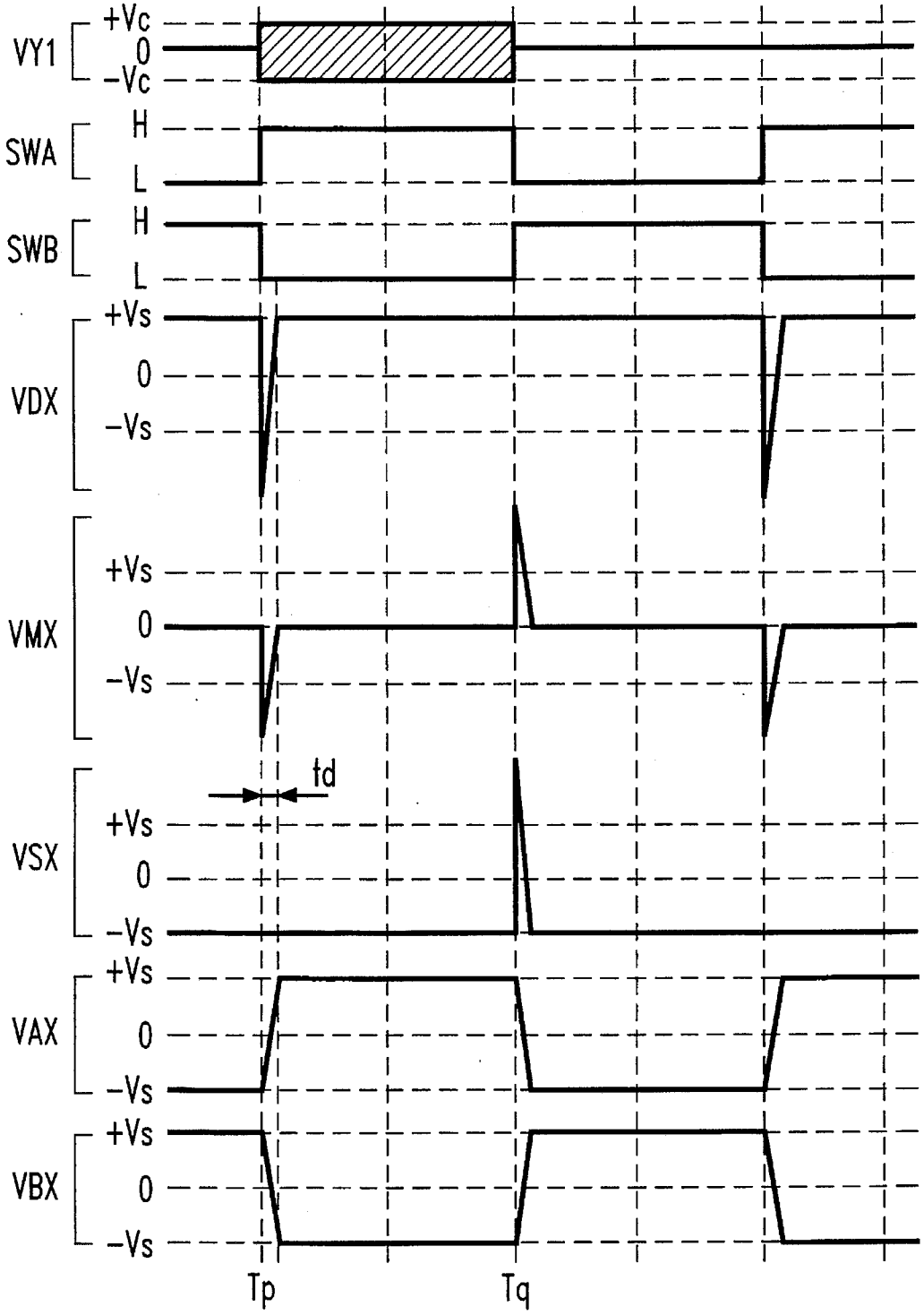
Figure 22:
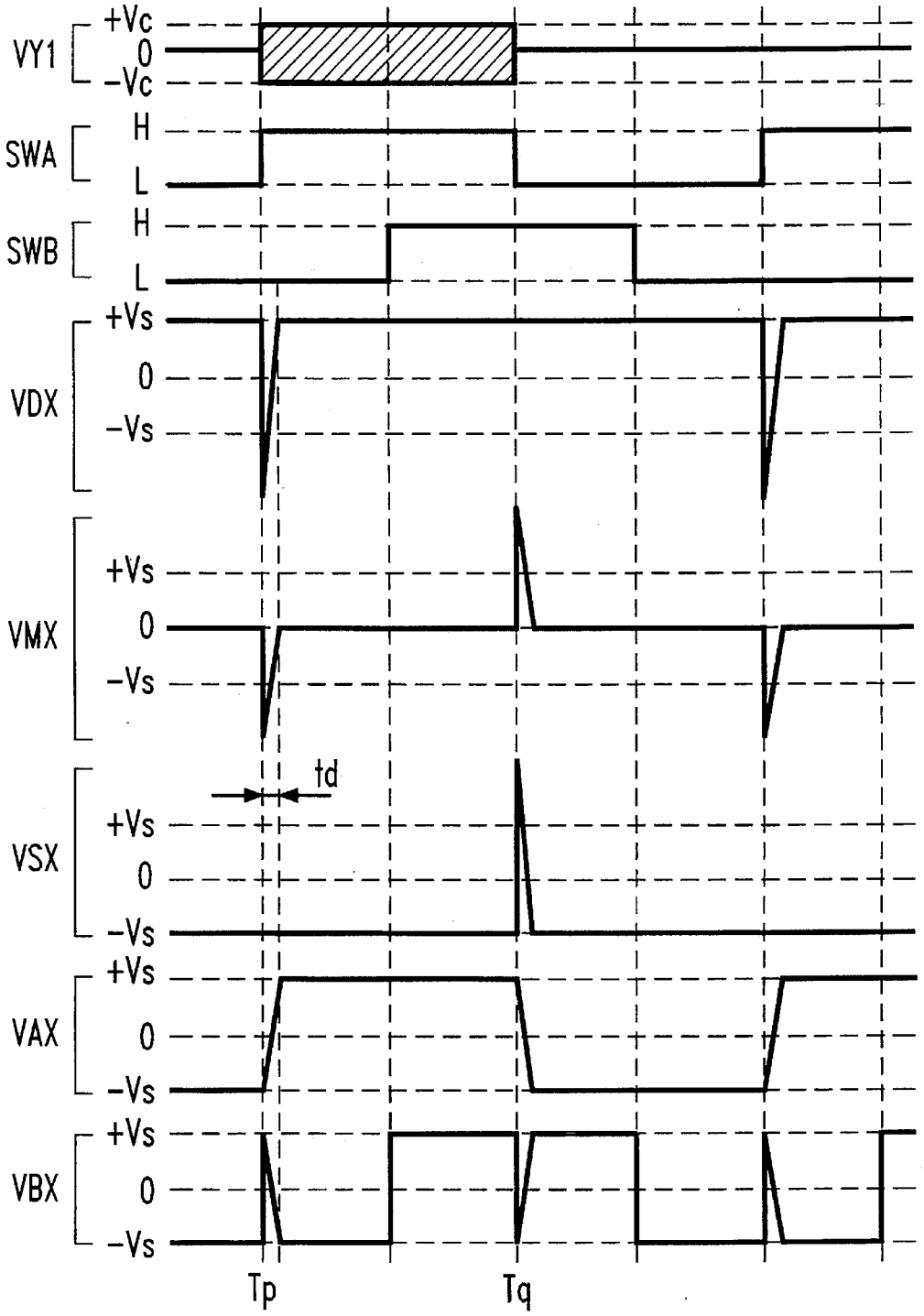

FIGS. 20, 21 and 22 show the results of a simulation during the non-selection period, using the structure shown in FIG. 19, when the proportional constant is set to a certain value. The timing relationships in these diagrams correspond to those of FIGS. 10, 11 and 12, respectively. The explanation will be given for FIG. 20.

When the switch state SWA described above changes from L to H at the time Tp, a current IH flows from VH to VM. This current is used to raise the potential of VMX, but since the adjusting circuit 100 described above lowers the potential of VM by the voltage component proportional to IH, as a result VMX does not rise but drops. At the time Tq, the switch state SWA changes from H to L and a current IL flows from VM to VL and is used to lower the potential of VMX, but since the adjusting circuit 100 raises the potential of VM by the voltage component proportional to IL, as a result VMX is not lowered but rises.

In consequence, the change of VDX acts in a direction that will lower the effective values for both VAX and VBX near the time Tp, but conversely, the change of VMX acts in a direction that will raise the effective values. This change acts in a direction that will lower the effective value of VMX in connection with VBX. As a result of these synthetic operations, the effective values of VAX and VBX approach in a direction such that they become equal to each other.

It is important to note that the operation described above operates as a positive feedback. Namely, the current IH flows on the basis of the potential difference between VH and VM, but when the current IH flows, VM is lowered in proportion to this value, and thus the positive feedback operation makes the value IH greater and greater, and decreases the value VM with the former. As a result, IH instantaneously becomes a large current and provides the following effect.

Generally, when the charge/discharge characteristics of the capacity are considered, the voltage across both ends of the capacity is proportional to the integration value of the charge/discharge current. In the case of a charge/discharge at small current, the voltage across both ends of the capacity changes slowly and the dullness is great. On the contrary, in the case of charge/discharge at a large current, the voltage across both ends of the capacity changes sharply and the dullness is small. Namely, in accordance with this embodiment, the liquid crystal as the capacitive load is instantaneously charged/discharged due to the aforementioned positive feedback operation, and the dullness of the driving voltage waveform applied to both ends of the liquid crystal is remarkably improved and approaches the ideal drive state. The time td shown in FIG. 20 is depicted on a greater scale than the practical simulation result to enable the effects of the present invention to be more easily understood.

The explanation for FIGS. 21 and 22 will be omitted because the same concept as described above also can be applied. It should noted that the effective values of VAX and VBX are regarded as being equal throughout all of FIGS. 20, 21 and 22. This can be understood more clearly when compared with FIGS. 10, 11 and 12. Namely, the effective values of VBX shown in FIG. 11, and VBX shown in FIG. 12 can be regarded as equal, but the effective value of VBX shown in FIG. 10 cannot be regarded as equal to these two. In contrast, in FIGS. 20, 21 and 22, the difference of the effective voltage values cannot be observed between VAX or between VBX, and the difference of the effective value also cannot be observed between VAX and VBX.

The explanation given above relates to the non-selection period. For the selection period, the differences of VDX, VSX do not exist from FIG. 20 to FIG. 22 and the time td is sufficiently small, as already described. According to the theory of the liquid crystal, the voltage change having a sufficiently short time need not be included in the calculation of the effective value from the response property of the liquid crystal, as already described, and from the practical point of view, it can be considered that there is no substantial difference in the drive force of the liquid crystal in the selection period between FIGS. 20 to 22 and FIG. 13. In contrast, in the cases of FIGS. 10 to 12, the dullness of the waveform is gentle and the drive force of the liquid crystal is affected accordingly.

Figure 29:
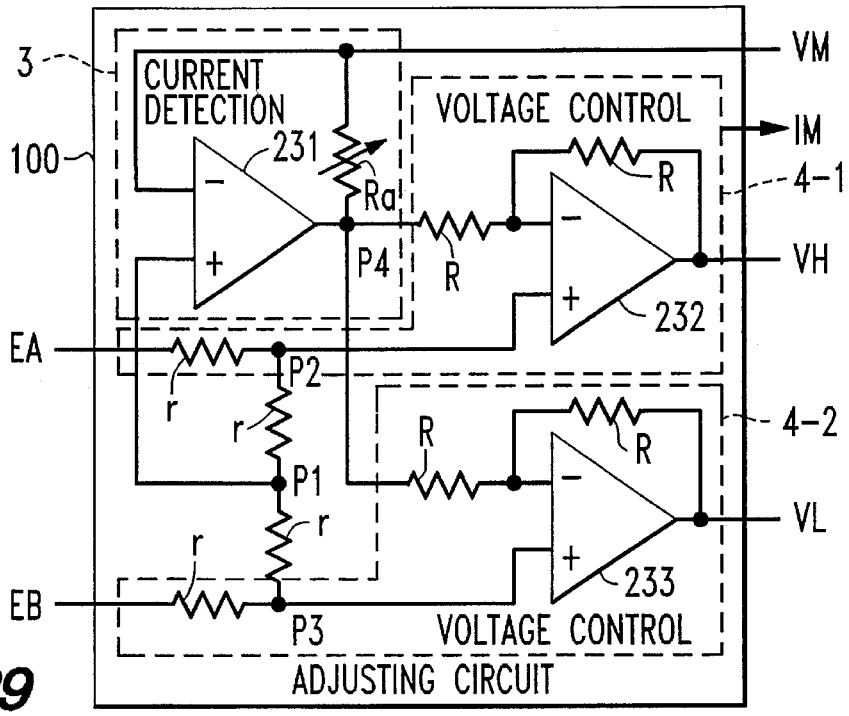
FIG. 29 is a structural circuit diagram showing the second embodiment of the present invention.

FIG. 29 shows the second embodiment of the present invention corresponding to the fourth aspect of the present invention as shown in FIG. 24 or 26. In FIG. 29, the adjusting circuit 230 is provided with a current detection means 3 and two voltage control means 4-1 and 4-2 and it is specifically constituted as follows. The input EA is connected to the point P2 through the resistor r and this point P2 is connected to the positive input terminal of the second differential amplifier 232. The input EB is connected to the point P3 through the resistor r and this point P3 is connected to the positive input terminal of the third differential amplifier 233. The point P2 described above is further connected to the point P1 through the resistor r and this point P1 is connected to the positive input terminal of the first differential amplifier 231 and is connected also to the point P3 through the resistor r. The output terminal P4 of this first differential amplifier 231 is fed back to the negative input terminal of the first differential amplifier 231 through the resistor Ra, to the negative input terminal of the second differential amplifier 232 through the resistor R, and further, to the negative input terminal of the third differential amplifier 233 through the resistor R. The output terminal of the second differential amplifier 232 is fed back to the negative input terminal of the second differential amplifier 232 through the resistor R. The output terminal of the third differential amplifier 233 is fed back to the negative input terminal of the third differential amplifier 233 through the resistor R. The output VH is taken out of the output terminal of the second differential amplifier 232, the output VL, from the output terminal of the third differential amplifier 233 and the output VM, from the negative input terminal of the first differential amplifier 231.

Assuming that the potentials at the points P1, P2, P3 and P4 are VP1, VP2, VP3 and VP4 and the current flowing out of the output VM to the load is IM, in the circuit construction shown in FIG. 29, then the following relationships stand:

$$VP1=(EA+EB)/2,\ VP2=(EA+VP1)/2,$$

$$VP3=(EB+VP1)/2,\ VP4=(EA+EB)/2+Ra\cdot IM$$

At this time, the outputs VH, VL and VM are given as follows, as is obvious from the functions of the differential amplifiers:

$$VH=EA-Ra\cdot IM,\ VL=EB-Ra\cdot IM,$$

$$VM=(EA+EB)/2$$

Namely, an intermediate potential between EA and EB is output to VM, and the potentials obtained by subtracting the change components proportional to the current IM from EA, EB are output to VH and VL, respectively. VM, however, is corrected in accordance with the current flowing out of VH, VL in the first embodiment, but VH and VL are adjusted in accordance with the current flowing out of VM in this second embodiment.

Assuming that, in the correction circuit 230 shown in FIG. 29, EA=+Vs and EB=−Vs, then, $$VH=+Vs-Ra\cdot IM,\ VL=-Vs-Ra\cdot IM,\ VM=0$$

Figure 30:
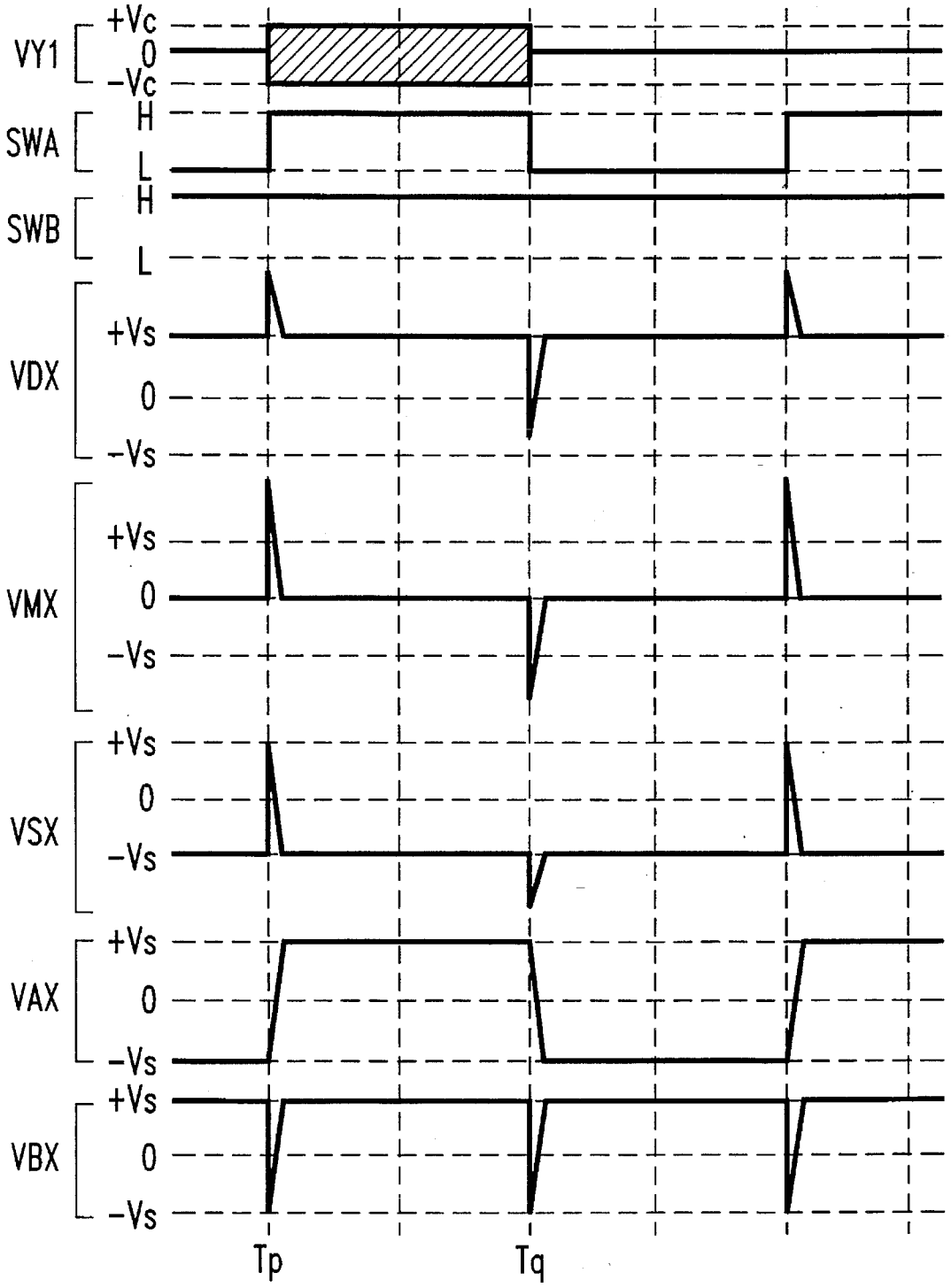
FIG. 30 is an explanatory view of the second embodiment of the present invention applied to the liquid crystal drive system model shown in FIG. 9.

The results obtained by simulating this circuit by the adjusting circuit 100 shown in FIG. 19 are illustrated in FIG. 30. The timing relationship of FIG. 30 is the same as those of FIGS. 10 and 20. When the switch state SWA changes from L to H at the time Tp in FIG. 30, a current −Im flows from VH to VM in FIG. 29 and VMX rises in the positive direction due to this current. As a result, VH and VL rise by Ra·IM. At this time, VH, IM and VM have the relationship of a positive feedback, and IM, which attains a large current, completes a charge and discharge of the liquid crystal of the aforementioned group A within a short time. When the switch state SWA changes from H to L at the time Tq, a current IM flows from VM to VL in FIG. 29, and VMX drops in the negative direction due to this current. As a result, VH and VL drop by Ra·IM. At this time, VL, IM and VM have the relationship of a positive feedback and IM completes a charge and discharge of the liquid crystal of the group A within a short time. All the operations are finished within an extremely short time, so that the voltages applied to both ends of the liquid crystals of the groups A and B become VAX and VBX, as shown in FIG. 30, and the dullness of the waveforms can be greatly improved. No difference of the effective value is observed between VAX and VBX, and the waveforms are obviously approximate to the original ideal waveforms.

In the first and second embodiments described above, the effects of the present invention are not substantially observed when the capacitance values formed by the groups A and B are equal to each other, and they are driven under completely opposite states. Namely, the condition in this case is such that the value of the current flowing in each group is equal and the current does not flow through the resistor RM, as explained with reference to FIG. 14. Therefore, in the first embodiment, the absolute values of the currents IH and IL in FIG. 1 are equal to each other, and since their polarities are opposite, the correction quantities are offset and become zero (0), so that VM is not adjusted. In the second embodiment, on the other hand, the value of the current IM in FIG. 29 becomes 0, so that VH and VL are not corrected. As described above, however, the quantity of the dullness of the waveform when the capacitance values formed by the groups A and B are equal is originally one-fourth of the maximum value. Furthermore, since the influence on the liquid crystal drive force become much smaller when the dullness of the waveform becomes small, as described already, the first and second embodiments can provide sufficient effects in almost all cases. Namely, a contrast substantially approximate to the theoretical limit can be obtained and the response also can be improved.

The first embodiment as explained above, shows an adjusting circuit in which current flown through said segment electrode is detected by the current detection means and the common electrode driving voltage is controlled by the output signal output from the current detection means and the second embodiments as explained above, shows an adjusting circuit in which current flown through said common electrode is detected by the current detection means and the segment electrode driving voltage is controlled by the output signal output from the current detection means.

In the present invention, the segment electrode driving voltage may be controlled by detected signal of the current detection means detecting current flown through the segment electrode or the common electrode driving voltage may be controlled by detected signal of the current detection means detecting current flown through the segment electrode.

Figure 31A:
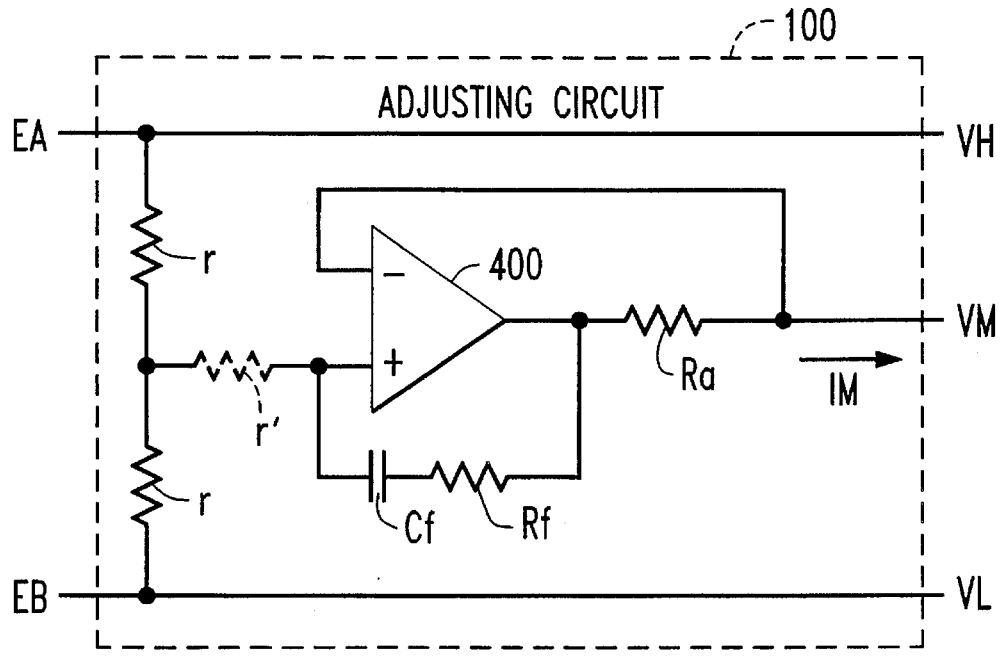
FIG. 31(A) and FIG. 31(B) are structural circuit diagram showing a third embodiment of the present invention.

FIG. 31(A) shows the third embodiment corresponding to the second aspect of the present invention as shown in FIGS. 27 and 28.

In FIG. 31(A), an adjusting circuit 100 having a function by which current flown through the common electrode is detected first by a current detection means and then the common electrode driving voltage is controlled by the detected signal output from the current detection means, is disclosed.

Note that in FIG. 31(A), both of reference voltages EA and EB are applied to a positive input terminal of an operational amplifier 400 through a resister r, respectively, and further an output of the operational amplifier 400 is positively fed back to the positive input terminal thereof through serially arranged resister Rf and capacitance Cf while an output of the operational amplifier 400 is negatively fed back to a negative input terminal thereof through a resister R and an output signal VM is output from the negative input terminal of the operational amplifier 400.

The operational mode of this embodiment is explained as follows.

When current IM is flown in this circuit, the output of the operational amplifier 400 is increased by IM. Ra and this amount of change is positively fed back to positive input terminal of the operational amplifier 400 through the capacitance Cf and thereby a voltage the output terminal thereof is steeply increased to cause an output voltage VM increased.

Therefore, current IM is also increased and thus rapid charge-discharge operation is carried out in the capacitance of the liquid crystal whereby a deformation of wave-form of voltage applied to both end terminals o the liquid crystal can be corrected.

In accordance with this adjusting method, it is apparent that the current flown through the segment electrode is detected first by a current detection means and then the segment electrode driving voltage is controlled by the detected signal output from the current detection means.

And further, this embodiment can be combined with the first or the second embodiment.

Figure 14A:
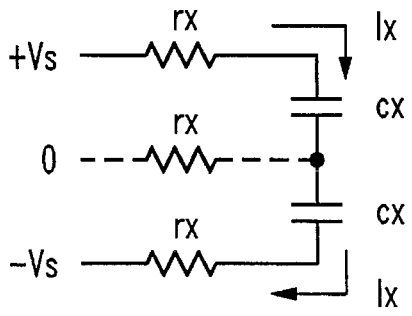
FIGS. 14A, 14B, 15A and 15B are explanatory views of the difference of the degree of dullness of the waveform in accordance with the display state.
Figure 14B:
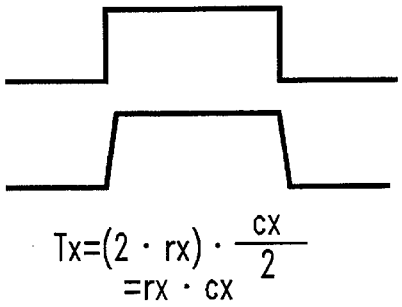
Figure 15A:
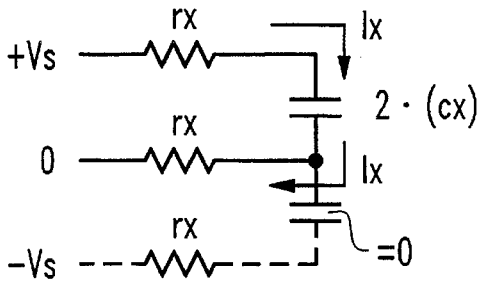
Figure 15B:
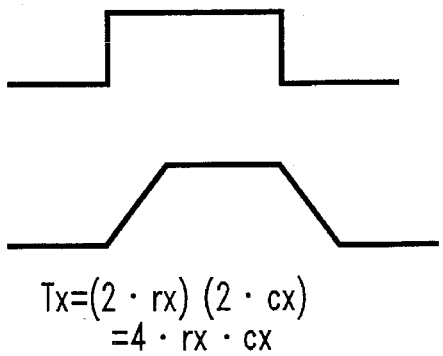
Figure 16A:
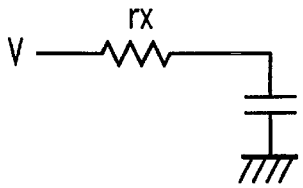
FIGS. 16A, 16B, and 16C is an explanatory view of the basic concept of the present invention.
Figure 16B:
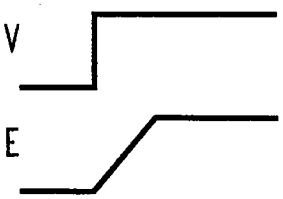
Figure 16C:
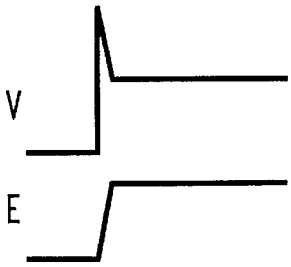

Note, that when a parasitic resistance value is large or a capacitance formed is large due to a surface area thereof being large, value rx·cx as shown in FIG. 14 is increased to an extent at which a deformation of the wave-form of the electrode driving voltage adversely effects to a driving force of the liquid crystal and thus a sufficient improved effect could not be obtained in the first or the second improved effect could not be obtained in the first or the second embodiment.

In such a case, it is prefer the third embodiment as shown in FIG. 31(A) is combined with the first or second embodiment.

Figure 3:
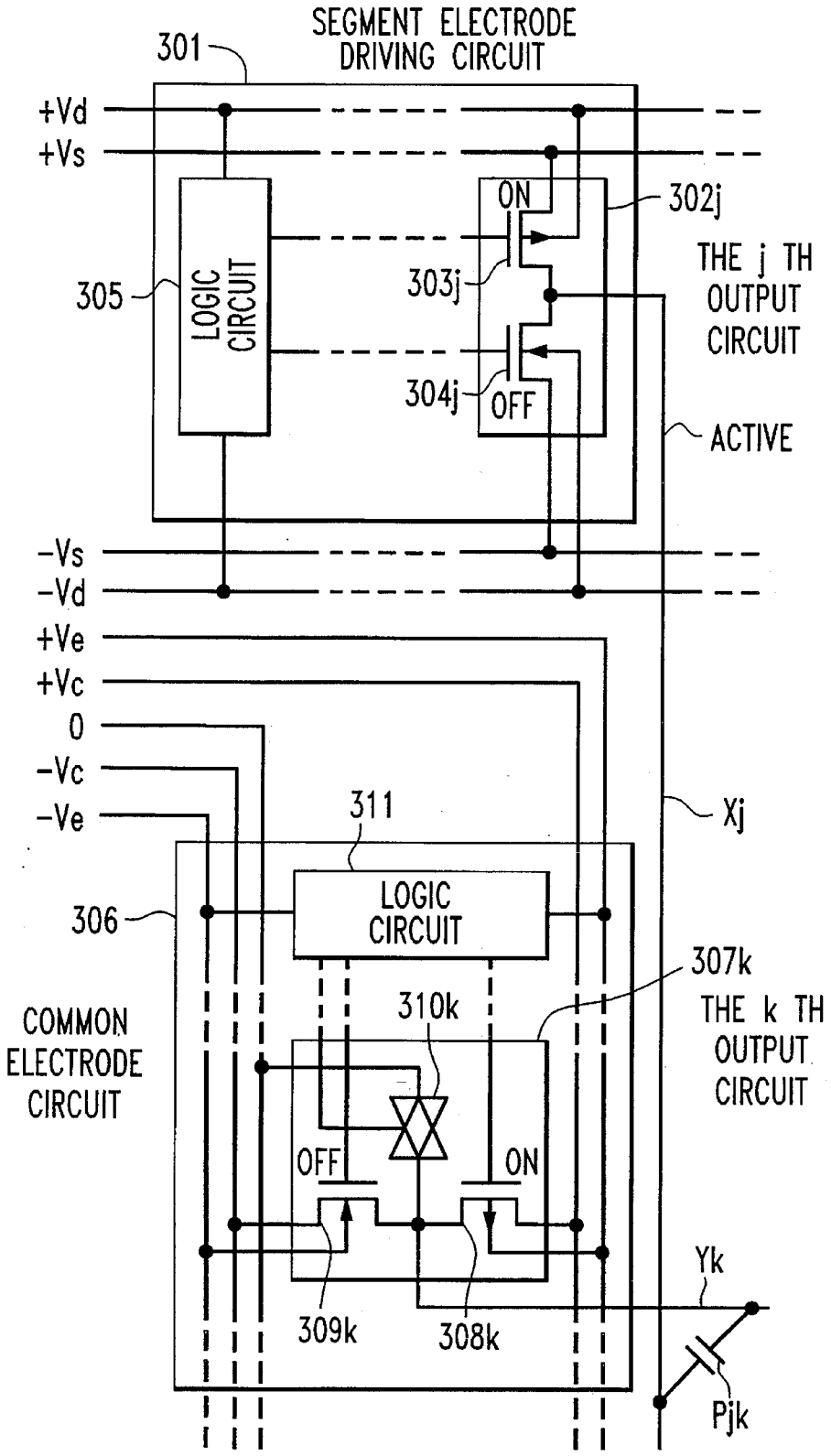
FIG. 3 PRIOR ART
FIG. 3 is a structural view showing an example of a liquid crystal driving circuit.
Figure 4:
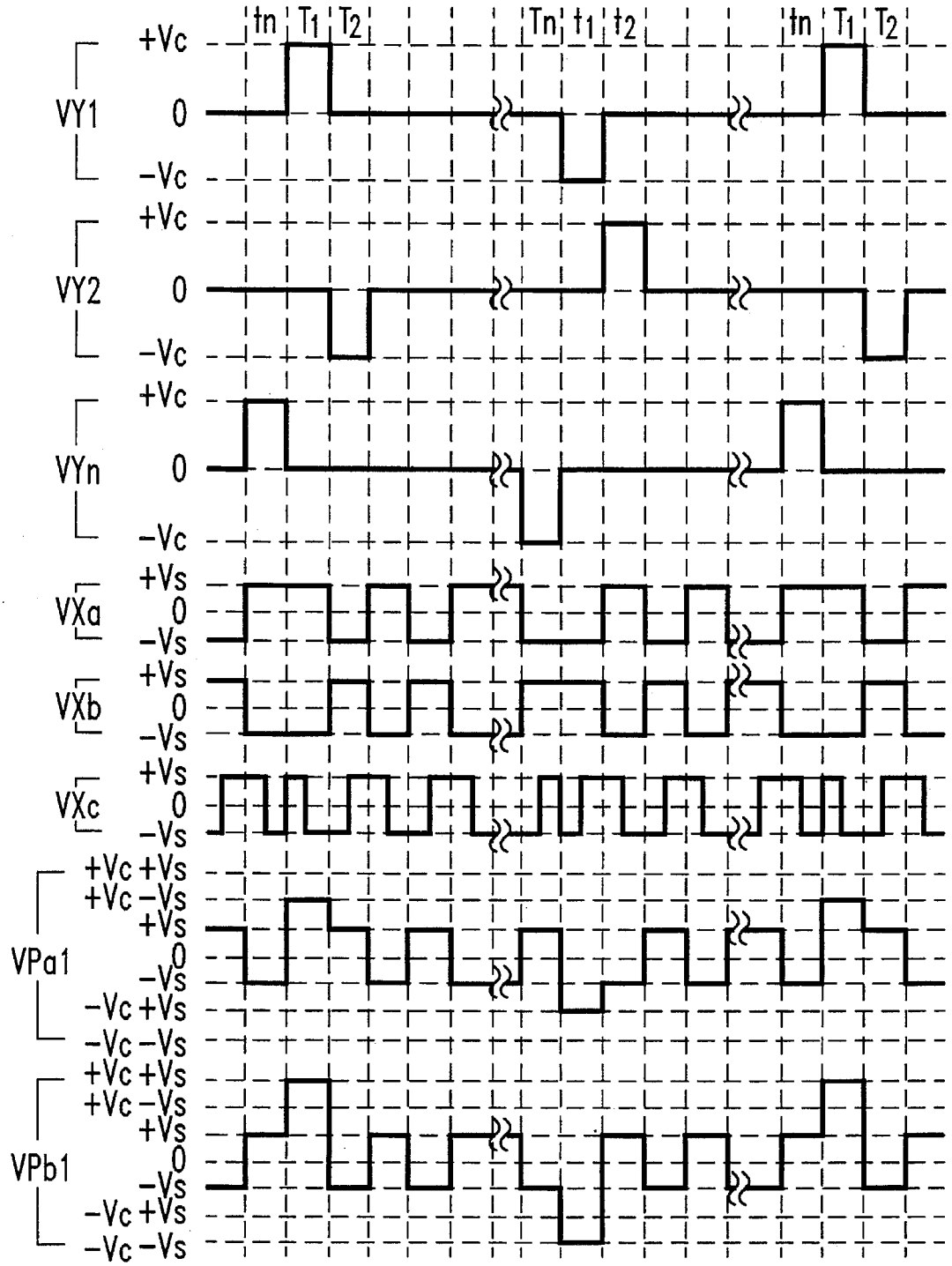
FIG. 4 is an operation waveform diagram showing an example of an ideal liquid crystal driving voltage waveform.

On the other hand, a deformation of a wave-form of a high driving voltage applied to the electrode during one selected period can be adjusted by detecting current flown through power source lines +Vc and −Vc as shown in FIG. 3, and self-controlling the voltage of the power source lines.

Figure 31B:
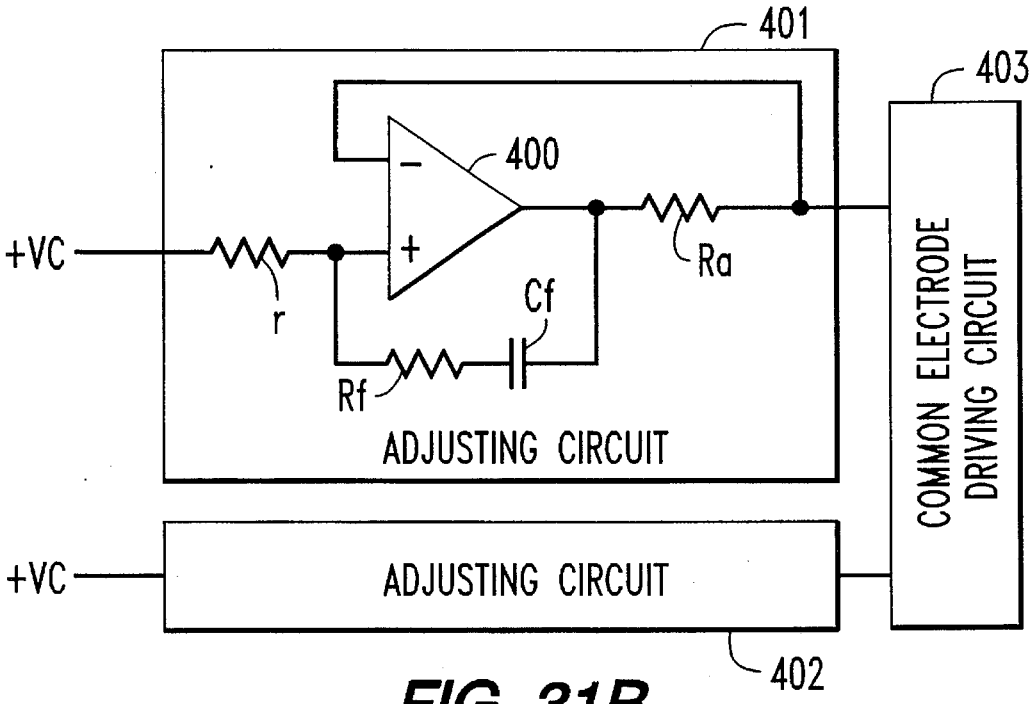

This embodiments is shown in FIG. 31(B) and in which a first adjusting circuits 401 is provided between the power source lines +Vc and common electrode driving circuit 403 and a second adjusting circuit 402 is provided between the power source lines +Vc and common electrode driving circuit 403, respectively.

Each of the adjusting circuits 401 and 402 has the same circuit construction as shown in FIG. 31(A) and thus an explanation about the operation thereof is omitted.

Figure 32:
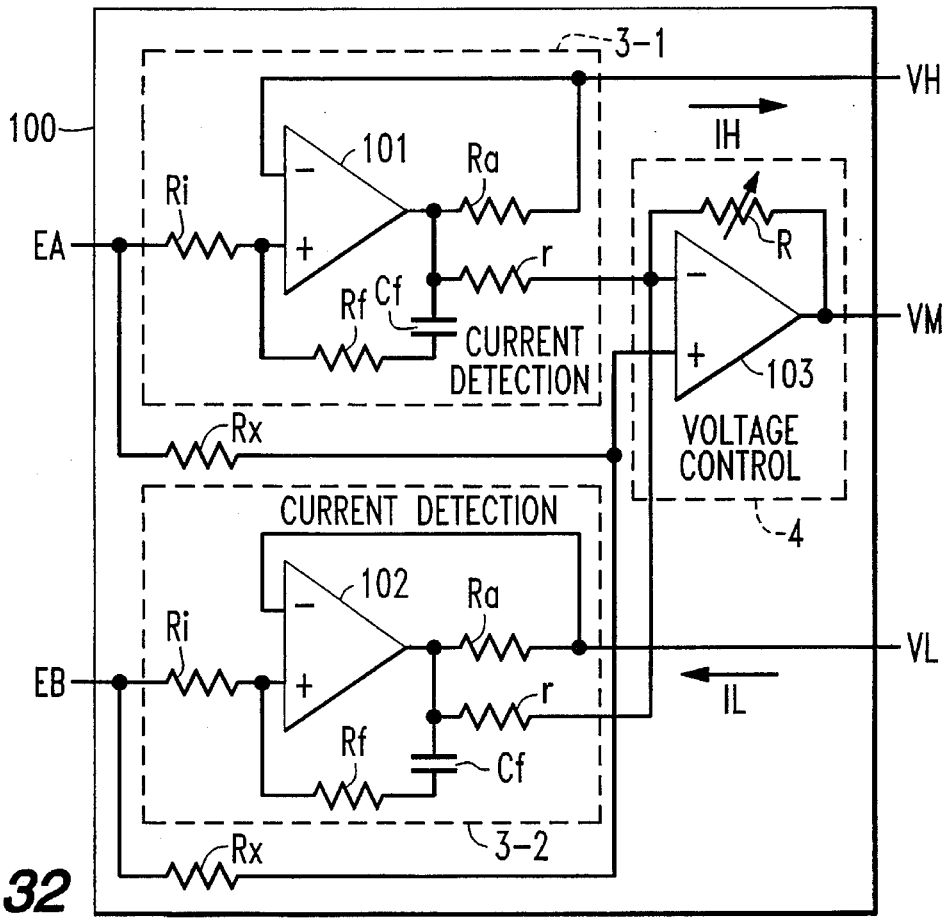
FIG. 32 is a structural circuit diagram showing the fourth embodiment of the present invention.

Note, that this embodiment may be combined with another embodiment. FIG. 32 shows a fourth embodiment of the present invention and in this embodiment, the first embodiment as shown in FIG. 1 and the third embodiment in which the segment electrode driving voltage is controlled by detecting current flown in the segment electrode utilizing the circuit construction as shown in FIG. 31(A) are combined.

In accordance with this embodiment, a driving condition of the liquid crystal can be changed into more ideal an optimal condition.

As apparent from FIG. 32, an adjusting method is disclosed in which current flown through the liquid crystal is detected first, and then both driving voltages applied to the common electrode and the segment electrode, respectively, are simultaneously controlled.

This embodiment as shown in FIG. 32, may be considered that a new function is added to the adjusting circuit of the first embodiment as shown in FIG. 1 and therefore, the same component of FIG. 32 as used in FIG. 1 is labelled with the same reference as used in FIG. 1 and thus an explanation about an operation thereof is omitted.

Note, that the adjusting circuit 250 shown in FIG. 32 is additionally provided with the following new function compared with the circuit of the first embodiment as shown in FIG. 1;

A reference voltage EA is applied to a positive input terminal of a first operational amplifier 101 through a resister Ri and the positive input terminal is connected to an output thereof through a circuit in which a resister Rf and a capacitor Cf are serially arranged.

On the other hand, a reference voltage EB is applied to a positive input terminal of a first operational amplifier 102 through a resister Ri and the positive input terminal is connected to an output thereof through a circuit in which a resister Rf and a capacitor Cf are serially arranged.

In FIG. 32, the function of the portion added to FIG. 1 is as follows. When the current IH flows, the voltage proportional to this current develops as the change component at the output terminal of the first differential amplifier 101. Since this voltage change component is fed back positively to the positive input terminal of the first differential amplifier 101 through the series circuit of the resistor Rf and the capacitor Cf, the potential at the output terminal of the first differential amplifier 101 rises, so that the potential of the output VH rises but the output VM drops. Then, the current IH increases and the output potential of the first differential amplifier further rises due to the positive feedback operation described above. When the current IL flows, the output VL drops rapidly while the output VM rises rapidly. These operations are finished in an extremely short time due to the positive feedback operation. The Rf in this circuit regulates the positive feedback quantity and suppresses the oscillation of the circuit.

Figure 33:
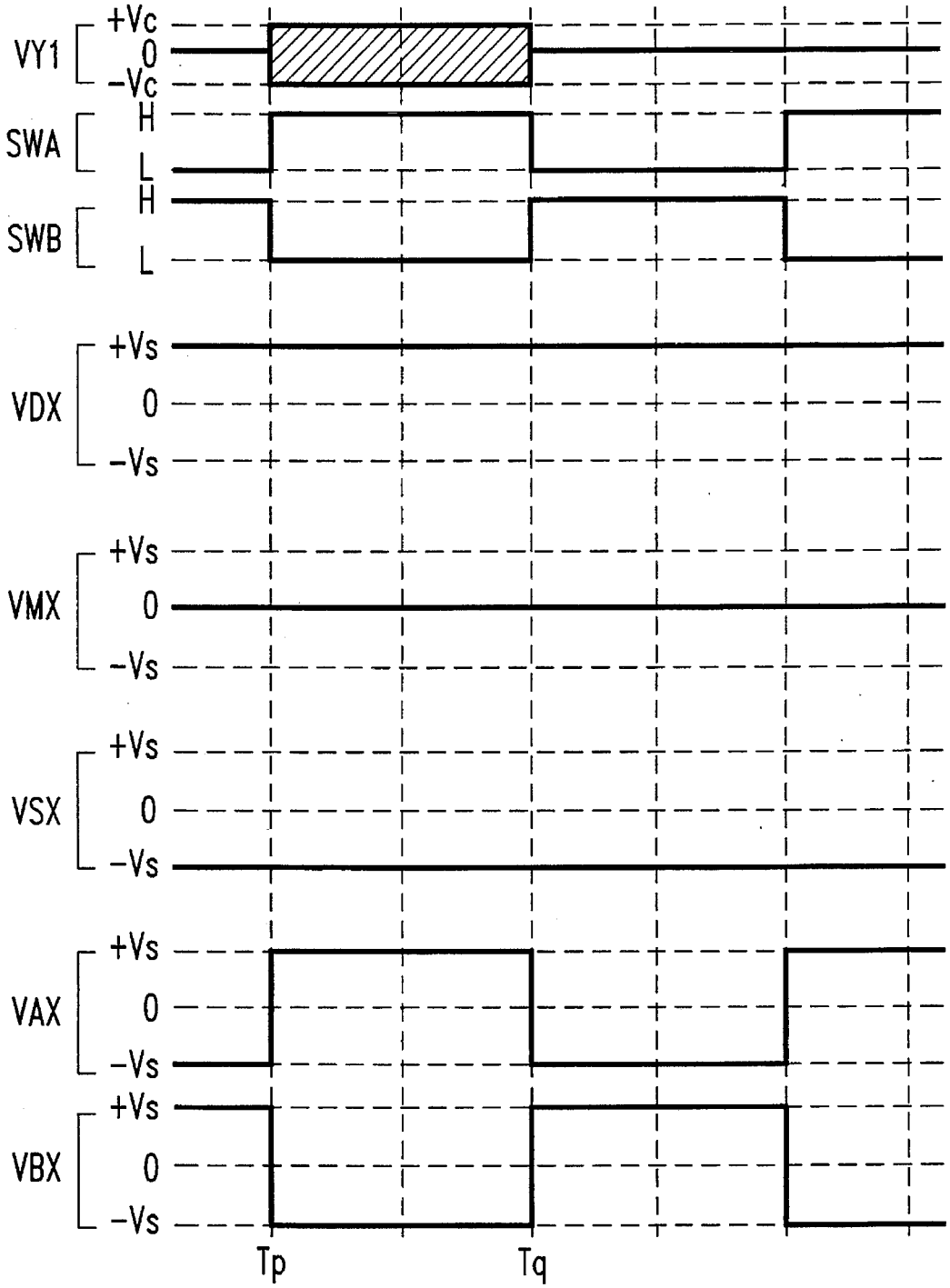
FIG. 33 is an explanatory view of the third embodiment of the present invention applied to the liquid crystal drive system model shown in FIG. 9.

Since a new feedback is added, the value of the constant at each portion of the correction circuit 250 becomes different from that of FIG. 1. FIG. 33 shows the results of a simulation carried out by optimizing these constants and combining the liquid crystal drive system model shown in FIG. 9. The timing relationships shown in FIG. 33 correspond to those shown in FIGS. 11 and 21. As can be seen, substantially complete and ideal drive waveforms can be obtained except for spikes of an extremely short period (not shown), even when the difference of the capacitance values of the groups A and B are 0 and when the difference of the capacitance values is maximum.

Figure 34:
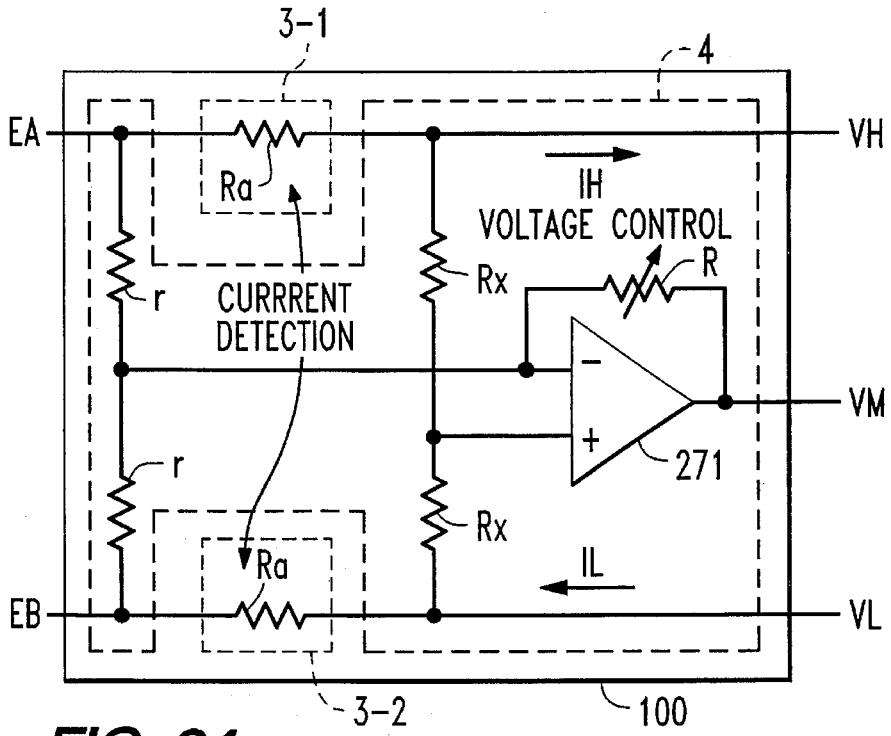
FIG. 34 is a structural circuit diagram showing the fifth embodiment of the present invention.

FIG. 34 shows a more definite embodiment, i.e., a fifth embodiment, obtained by simplifying the embodiment shown in FIG. 1, as although the embodiment shown in FIG. 1 provides remarkable effects, it is not free from the following problems:

(1) The dullness of the waveform is a phenomenon having a high speed of up to 1 μS, and it is necessary to output a relatively large current having a large amplitude, instantaneously, in addition to the high speed of from some dozens to about 100 nS.

(2) Generally, high speed amplifiers satisfying the requirement (1) consumed a large amount of current and cannot be easily applied to compact apparatuses.

(3) Generally, high speed amplifiers satisfying the requirement (1) are very expensive, and the practice of the invention is therefore limited.

The embodiment shown in FIG. 34 is directed to solving the problems described above, and can provide the required effects at a reduced cost. In FIG. 34, the correction circuit 270 is constituted as follows. The negative input terminal of the differential amplifier 271 is connected to the potential Ea through the resistor r, to the potential EB through the resistor r, and further, to the output terminal VM of the differential amplifier 271 through the resistor R. The other output terminal VH is connected to the potential EA through the resistor Ra and to the positive input terminal of the amplifier 271 described above through the resistor Rx. Furthermore, the other output terminal VL is connected to the potential EB through the resistor Ra and to the positive input terminal of the differential amplifier 271 through the resistor Rx.

In this circuit construction, the outputs are given as follows:

$$VH=EA-Ra\cdot IH,\ VL=EB+Ra\cdot IL,$$

$$VM=(EA+EB)/2-(½+R/r)\cdot Ra\cdot(IH-IL)$$

When the simulation is carried out by replacing the correction circuit 270 shown in FIG. 34 by the correction circuit 100 shown in FIG. 19, it is found that substantially the same result can be obtained as in FIGS. 20 to 22, by appropriately selecting the constants by sufficiently reducing the Ra value, or the like. Since the number of differential amplifiers may be smaller in the embodiment shown in FIG. 34 than in the embodiment shown in FIG. 1, the problems with the embodiment of FIG. 1 can be easily solved.

Figure 2:
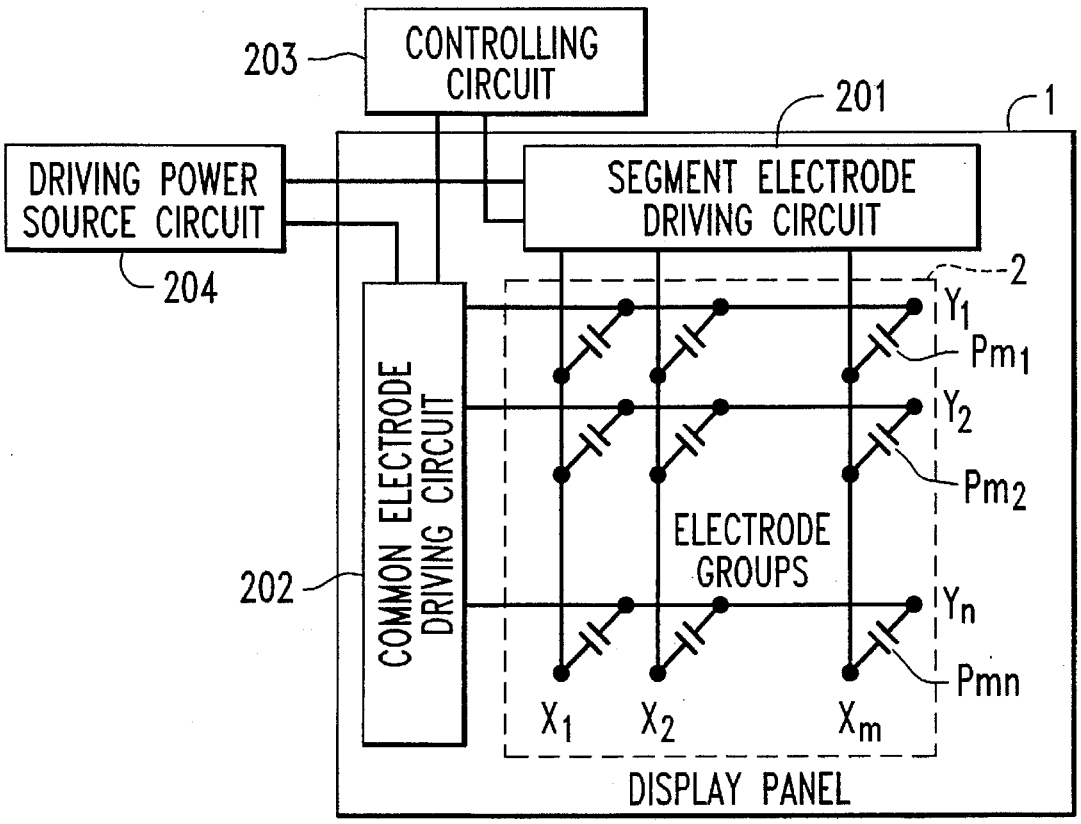
FIG. 2 PRIOR ART
FIG. 2 is a structural view showing the structure of a simple matrix type liquid crystal display device.

In the circuit construction shown in FIG. 2, either one, or both, of the segment electrode drive circuit 201 and the common electrode drive circuit 202 are sometimes disposed inside the display panel. In the active type liquid crystal panel, for example, transistors are fabricated inside the panel and these drive circuits are assembled. In the passive liquid crystal panel, on the other hand, the drive integrated circuit is disposed on the panel in accordance with the system referred to as "COG (Chip On Glass)". In these cases, the drive voltages applied to the liquid crystal are supplied to the drive circuits from outside the panel, through the wirings inside the panel, and since the wirings inside the panel generally have a high specific resistance, this resistance which can not be neglected.

In Japanese Patent Unexamined Publication (Kokai) No. 2-90280 (hereinafter referred to as the "reference 2"), the Applicant of the present invention proposed:

(1) An electrooptical display device characterized by including outgoing electrodes for detecting the potential at a specific point inside a display panel; and (2) A method of driving an electrooptical display device characterized by detecting the potential at a specific point inside a display panel and effecting a control such that the potential at said specific point reaches a specific value. In this technology is applied to the present invention, more effective effects can be obtained.

Figure 35:
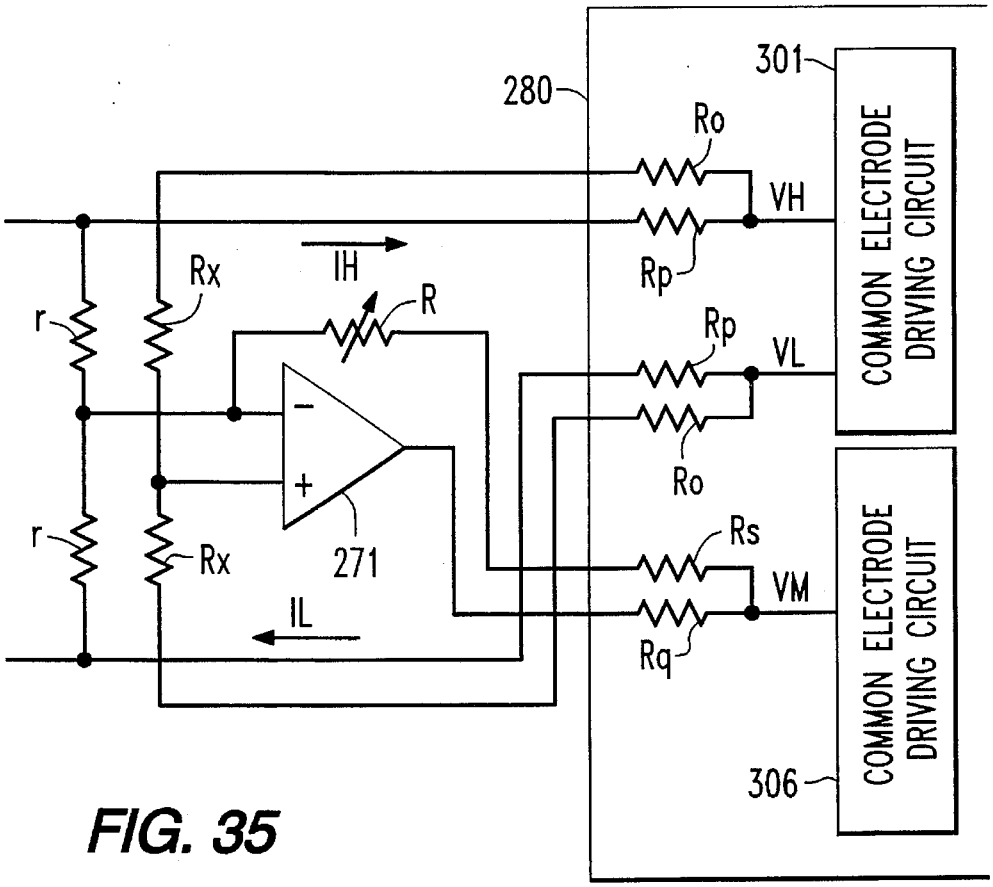
FIG. 35 is a structural circuit diagram showing the sixth embodiment of the present invention.

FIG. 35 is a structural view of the sixth embodiment, showing the technology proposed in the reference 2 applied to the embodiment of the present invention shown in FIG. 34. This circuit assumes a passive liquid crystal panel wherein the segment electrode drive circuit 301 and the common electrode drive circuit 306 shown in FIG. 3 are disposed inside the display panel 280 by COG. In FIG. 35, the segment electrode drive power supply line of the segment electrode drive circuit 301, to which VH(+Vs) is supplied, is taken out to the outside through the wiring resistance (inclusive of the connection resistance for external connection; hereinafter the same) Rp inside the panel, is applied with EA and is taken out through the wiring resistance Ro. Furthermore, it is connected to the positive input terminal of the differential amplifier 271. The segment electrode drive power supply line, to which VL(−Vs) is supplied, is taken out through the wiring resistance Rp inside the panel, is applied with EB and is taken out to the outside through the wiring resistance Ro. Furthermore, it is connected to the positive input terminal of the differential amplifier 271. The common electrode drive power supply line of the common electrode driving circuit 306, to which VM(0) is supplied, is taken out through the wiring resistance Rq inside the panel, is connected to the output terminal of the differential amplifier 271, is taken out through the wiring resistance Rs and is further connected to the negative input terminal of the differential amplifier 271. The potential EA is applied to the negative input terminal of the differential amplifier 271 through the resistor r, and EB is supplied further through the resistor r.

In the embodiment shown in FIG. 35, the wiring resistance Rp itself inside the panel 280 plays the role of the current detection resistor Ra shown in FIG. 34. If such a construction is employed, it is not necessary to dispose the current detection resistor outside. Accordingly, the resistance values of the EA and EB power supply lines need not be increased, and thus the possibility of increasing the dullness of the waveform of the segment electrode driving voltage applied to the liquid crystal through the segment electrode driving circuit 301 is eliminated. The resistor Rx in FIG. 34 is replaced in FIG. 35 by Rx+Ro but it is only necessary that this resistor be sufficiently greater than Ra (Rp), and the addition of Ro does not exert an adverse influence on the circuit operation. Furthermore, the resistor R in FIG. 34 is R+Rs in FIG. 35, but since R is the variable resistor, the value R+Rs may be considered as falling within the range of adjustment. Since the adjustment ratio R/r can be made small because the detecting position of the potential to be fed back to the negative input terminal of the differential amplifier 271 changes, the resistor r can be set to a relatively large value and a bleeder current flowing from EA to EB through the resistor r can be reduced.

Figure 36:
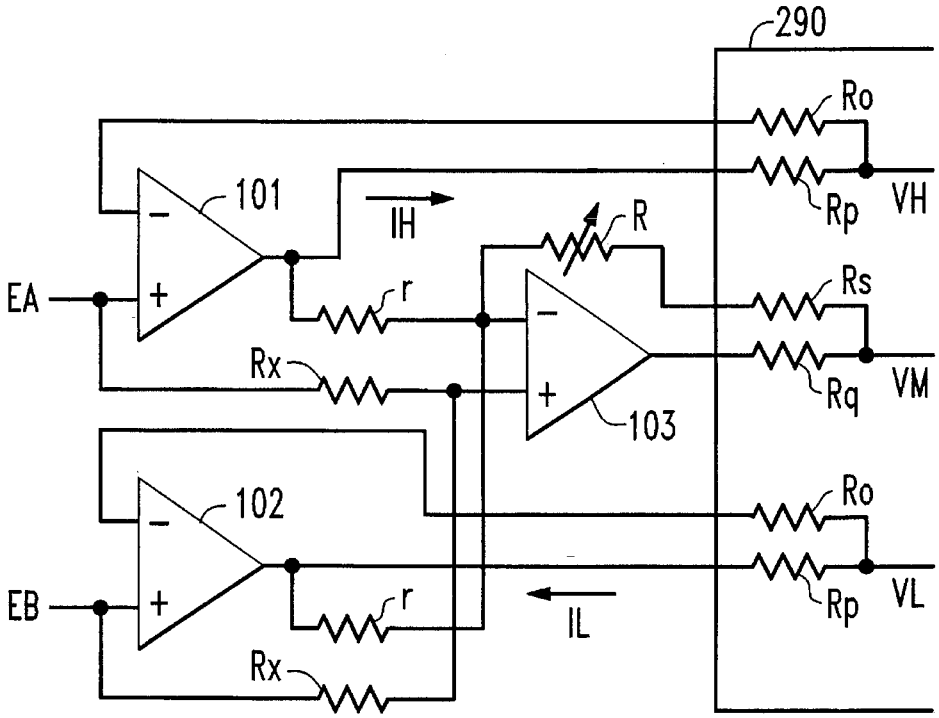
FIG. 36 is a structural circuit diagram showing the seventh embodiment of the present invention.

It is obvious that the technology proposed in the reference 1 can be applied also to the embodiments shown in FIGS. 1, 29 and 32 of the present invention. FIG. 36 shows the application of the technology of the reference 1 to the embodiment shown in FIG. 1 of the present invention referred to the seventh embodiment, and this can further improve the characteristics. Like reference numerals are used in this drawing to identify like constituents as in FIG. 1 and the explanation of such members is omitted. In FIG. 36, the resistor Ra in FIG. 1 is replaced by the wiring resistance Rp inside the panel 290. The wiring resistance Rs inside the panel 290 is added to the resistor R in FIG. 1. Here, the differential amplifier 101 in FIG. 36 operates in such a manner that the potential of VH in FIG. 36 is kept at a constant potential EA, and the differential amplifier 102 operates in such a manner that the potential of VL in FIG. 36 is kept at a constant potential EB, so that the current drop component of the resistor Rp is corrected and the same effect can be thus obtained so that RD and RS of the model shown in FIG. 9 become extremely small. Accordingly, the dullness of the waveforms of VDX, VSX is greatly reduced, and more remarkable effects can be obtained.

Figure 37:
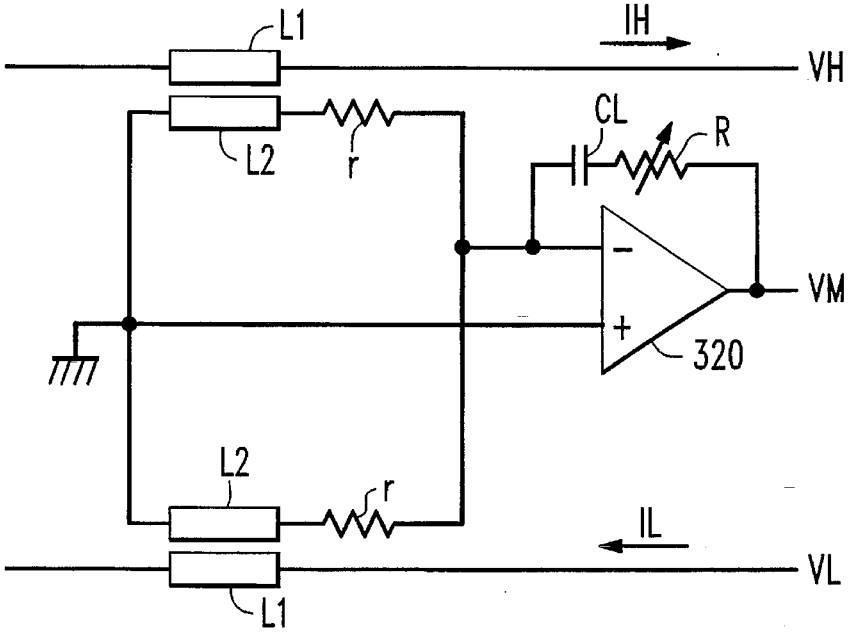
FIG. 37 is a structural circuit diagram showing the eighth embodiment of the present invention.

FIG. 37 shows the eighth embodiment of the present invention, wherein an inductor is utilized for the current detection. The output VH(+Vs) is connected to EA through the inductor L1 and the output VL(−Vs) is connected to EB through the inductor L1. The output VM is connected to the output terminal of the differential amplifier 320 and to the negative input terminal of the differential amplifier 320 through the series circuit of the resistor R and the capacitor CL. This input terminal is grounded through the resistor r and through another inductor L2, which is coupled with the inductor L1 coupled to +Vs, with a coupling coefficient M, and is further grounded through the resistor r and through the inductor L2, which is connected to the inductor L1 connected to −Vs, with the coupling coefficient M. The positive input terminal of the differential amplifier 320 is grounded.

FIG. 37 will be explained briefly. When the current IH flows, for example, a voltage obtained by differentiating the current IH develops at the inductor L2 coupled with the inductor L1 which is connected to EA. This voltage is integrated by the integration circuit consisting of the differential amplifier 320 and the capacitor CL, and a voltage proportional to the current IH develops at the output terminal VM of the differential amplifier 320. When the current IL flows, on the other hand, a voltage obtained by differentiating the current IL develops at the inductor L2 coupled with the inductor L1 which is connected to EB. This voltage is integrated by the integration circuit consisting of the differential amplifier 320 and the capacitor CL, and a voltage proportional to the current IL develops at the output terminal VM of the differential amplifier 320. The values of L1 and L2 are extremely small and can be formed easily by the wirings alone, by designing the wirings on the printed board. Note, a circuit for defining the portion corresponding to the integration constant must be added to FIG. 37, although such a circuit is not shown in FIG. 37.

Figure 5A:
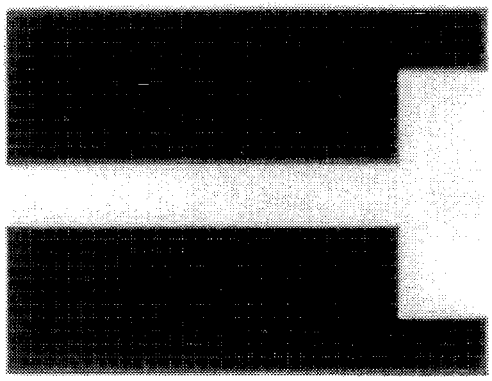
FIG. 5 is an explanatory view of the influences of cross-talk.
Figure 5B:
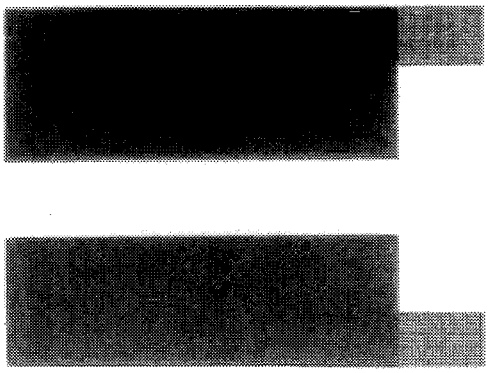
Figure 5C:
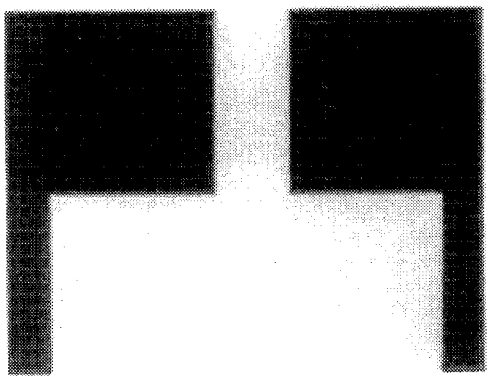
Figure 5D:
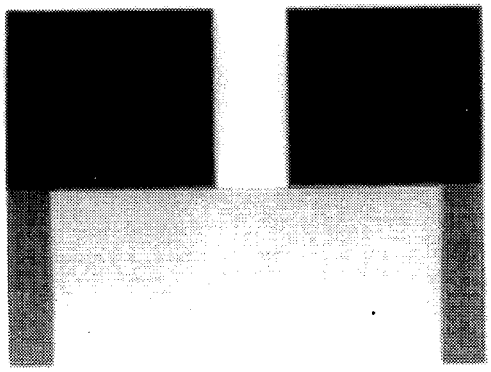
Figure 6:
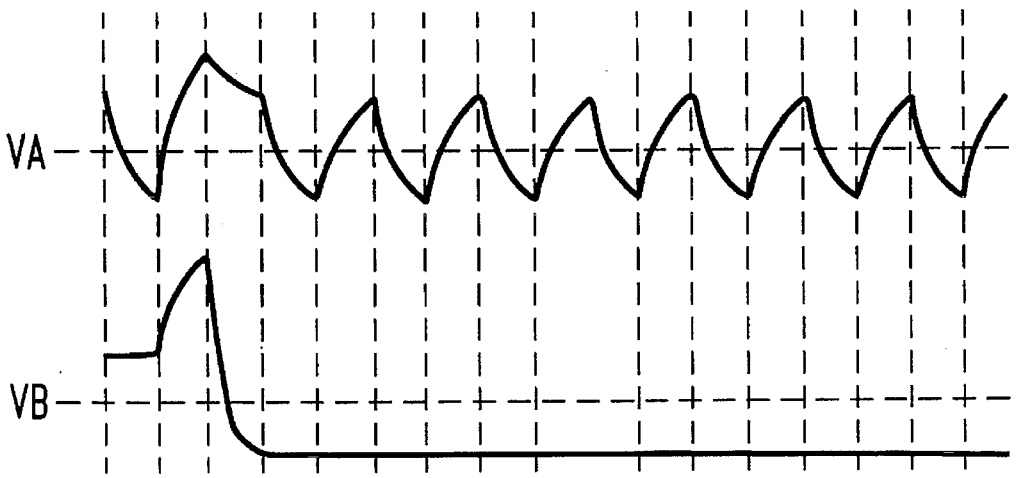
FIG. 6 is a conventional explanatory view explaining the cross-talk.
Figure 7:
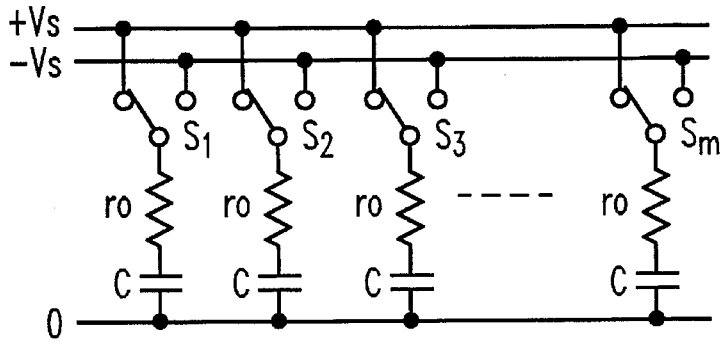
FIG. 7 PRIOR ART
FIG. 7 shows a model of a liquid crystal drive system is based on the conventional explanation.
Figure 8:
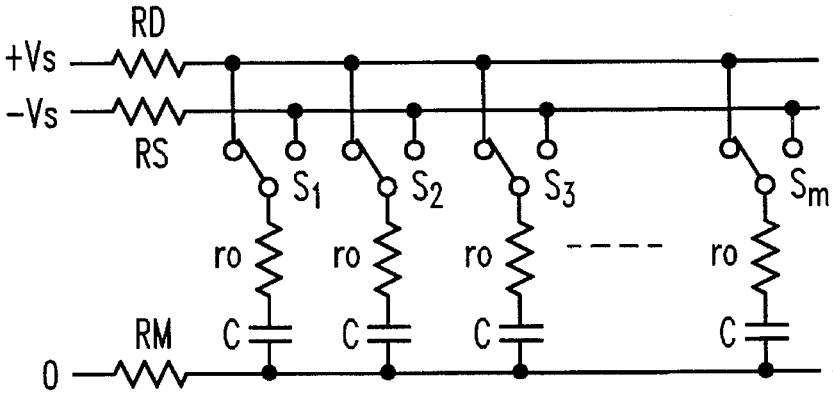
FIG. 8 shows a first model of a liquid crystal drive system according to the present invention.

As is obvious from the description given above, the present invention brings the effective voltage values in the non-selection and selection periods to the theoretical values by correcting the waveform of the liquid crystal driving voltage to the original ideal waveform in all the conditions inclusive of a gradation display, can solve not only the problems resulting from the dullness of the waveform such as the drop of contrast and deterioration of response, but also the cross-talk. Since the present invention detects the current that actually flows through the liquid crystal, the invention can obviously make a stable correction against the complicated changes of the current in a gradation display and against environmental changes. The display device obtained by actually practicing the present invention provides an excellent display quality. Note, since the power supply is changed when practicing the present invention, the relationship between potentials of the latch-up circuit and the like must be examined and counter-measures therefor should be taken. However, such measures will be omitted as they are irrelevant to the gist or main point of the present invention. When the panel is divided into upper and lower two parts and the displays of these two parts are different as explained with reference to FIGS. 5(C) and 5(D), the present invention must be applied individually to these two parts. If the same display is effected for the two parts, however, the present invention can be applied in common to both.

The effects obtained by the present invention can be summarized as follows. Since the present invention drives the liquid crystal under the ideal state, it can provide a display device having an excellent performance in that:

(1) the theoretically greatest contract can be obtained;

(2) the device is free from cross-talk;

(3) the response can be improved; and (4) the display device can be applied even to devices having a gradation display, such as a liquid crystal television receiver.

Thus, the effects of the present invention are very high. Recently, the load on the drive circuit is increased because a greater number of pixels are incorporated in the display device, the display device must effect a color display, and the screen is enlarged. In addition, a packaging system called the "COG (Chip On Glass) system", for example, has been adopted, and the condition associated with the parasitic resistance tends to get worse. Nonetheless, the present invention can fully exhibit sufficient effects and can contribute greatly to the development of the display devices. Note, the parasitic resistance of each part as the real cause of the problems must be further continued because the present invention is intended to solve the problems from the aspect of the drive circuit, although the present invention provides very high effects.

Finally, some additional remarks on the present invention will be made.

(1) The foregoing description is given on the liquid crystal display device. As is obvious from the description, however, the present invention is effective for an EL display device, for example. Therefore, the range of the application of the present invention is not particularly limited to the liquid crystal display device.

Figure 38:
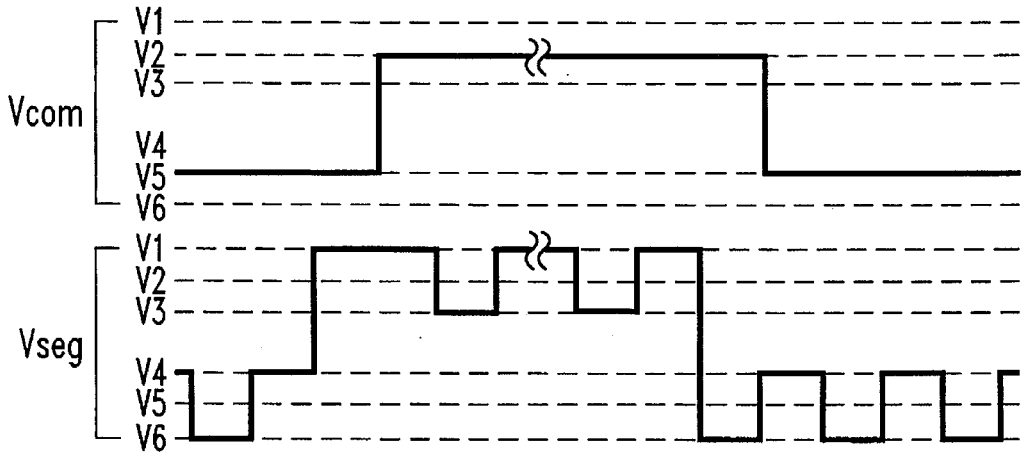
FIG. 38 is a waveform diagram showing an example of a liquid crystal drive waveform different from that used for the explanation of the present invention.
Figure 39:
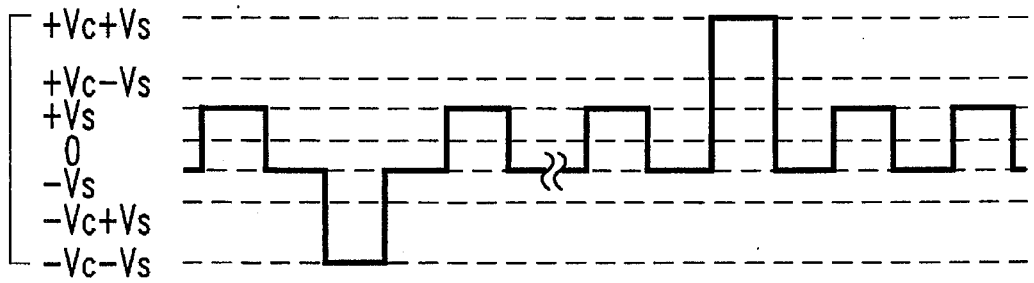
FIG. 39 is an explanatory view of the present invention when applied to the example shown in FIG. 38.

(2) The definite drive methods of the display device are diversified as already described. Besides the drive method used for the explanation, there is a method which drives the segment electrodes and the common electrodes by the use of the drive voltages shown in FIG. 38, for example. However, the drive method of FIG. 38 becomes the one shown in FIG. 39 when the potential of the common electrode driving voltage Vcom is considered as the reference (0), and the present invention can be obviously applied thereto, as well. Accordingly, the present invention is not particularly limited to the drive method explained herein. Note, that, when the present invention is applied to FIG. 38, the adjusting operation as shown in the present invention, may be carried out in a selected period.

(3) The definite embodiments of the present invention are not particularly limited to those described herein.

(4) For example, the first embodiment shown in FIG. 1 represents the method which detects both the currents flowing through the input voltages EA and EB and controls the output voltage VM. It has been confirmed, however, that the effects of the invention can be obtained if the control quantity is changed even when either one of EA and EB is used for controlling VM. Accordingly, the present invention is not particularly limited to the detection of all the currents that flow through the liquid crystal.

(5) The detailed description of the invention given above has concentrated on the simple matrix type liquid crystal display device, but in "active type matrix display devices" also a write operation is effected at the time of the selection of rows, and consequently, the power supply lines change. As a result, the correct quantity of charge is not charged or discharged, and thus the contrast drops and response drops in some cases. The present invention also can be applied to such cases and can obviously provide great effects. Accordingly, the present invention is not particularly limited to the simple matrix type display device.

(6) Similarly, in the case of the display structure which does not constitute the matrix (such as the structure referred to as the "segment type"), the display quality can be improved by the application of the present invention, if a drop in the display quality resulting from a current drop exists. Accordingly, the present invention is not particularly limited to the matrix type as the structure of the display device.

In each embodiment of the present invention, the adjusting circuit has a positive feedback circuit and it will be explained with reference to FIGS. 40 to 42, hereunder.

Figure 40:
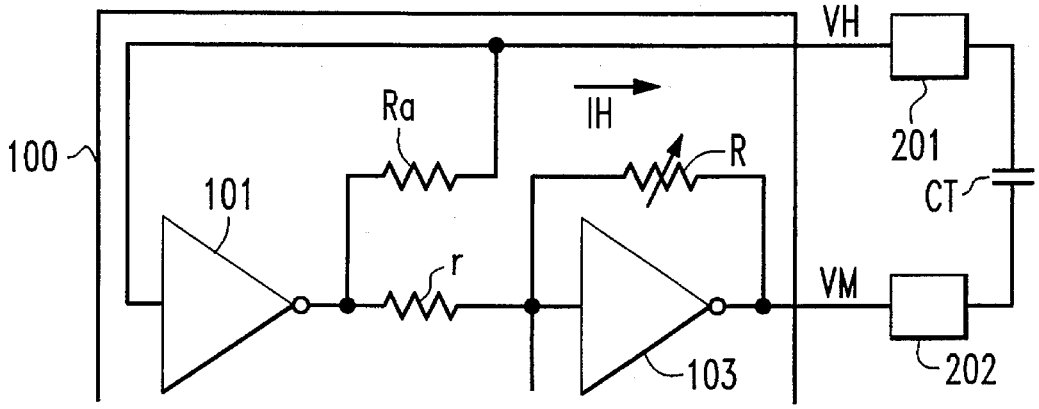
FIG. 40 is a view illustrating a positive feed-back circuit formed in an adjusting circuit as shown in FIG. 1.

FIG. 40 shows a part of the circuit construction of FIG. 1 and illustrating a positives feedback circuit comprising operational amplifiers 102 and 103, used in the circuit in FIG. 1.

FIG. 40 is modified from FIG. 1 in such a manner that the operational amplifiers 101 and 103 are converted into inverters 101 and 103 only taking each negative input terminal thereof into account, in order to understand this easily.

In that, an output of the inverter 103 is applied to an one end terminal of an equivalent capacity CT of the liquid crystal display panel through the common electrode driving circuit 202 and another end terminal of the liquid crystal display panel is connected to an input terminal of the inverter 101 through the segment electrode driving circuit 201.

While, an output terminal of the inverter 101 is connected to an input terminal of the inverter 102 through a resister r.

As apparent from FIG. 40, it can be understood that the inverters 101 and 103 form a positive feedback circuit through the capacity CT.

As the same way, it is apparent that the operational amplifier 102 and 103 provided in the circuit as shown in FIG. 1 also form a positives feedback circuit through the capacity CT of the liquid crystal.

Figure 41:
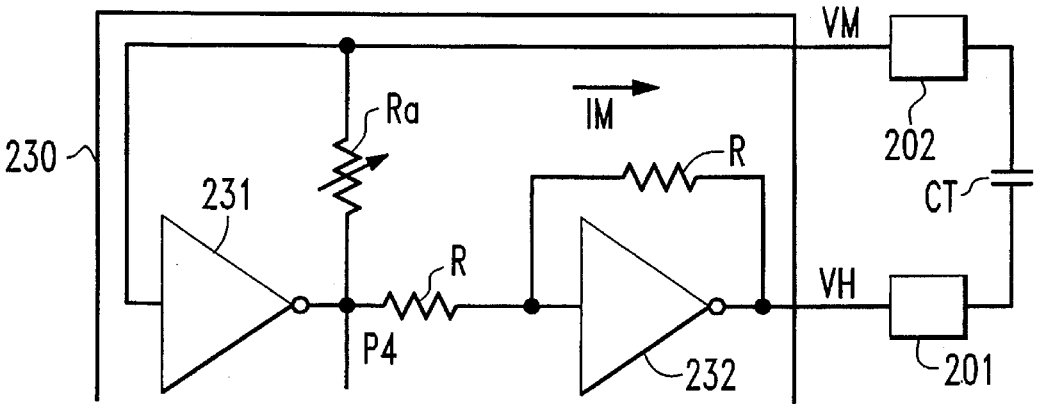
FIG. 41 is a view illustrating a positive feed-back circuit formed in an adjusting circuit as shown in FIG. 29.

FIG. 41 also explains the fact that the operational amplifiers 231 and 232 used in the embodiment as shown in FIG. 29, form a positive feedback circuit. FIG. 41 is modified from FIG. 29 in such a manner that the operational amplifiers 231 and 232 are converted into inverters 231 and 232 only taking each negative input terminal thereof into account, in order to get better understanding of this fact.

In that, an output of the inverter 232 is applied to an one end terminal of an equivalent capacity CT of the liquid crystal display panel through the segment electrode driving circuit 201 and another end terminal of the liquid crystal display panel is connected to an input terminal of the inverter 231 through the common electrode driving circuit 202.

While, an output terminal of the inverter 231 is connected to an input terminal of the inverter 232 through a resistor R.

As apparent from FIG. 41, it can be understood that the inverters 231 and 232 form a positive feedback circuit through the capacity CT.

As the same way, it is apparent that the operational amplifier 231 and 233 provided in the circuit as shown in FIG. 29 also form a positive feedback circuit through the capacity CT of the liquid crystal.

Figure 42:
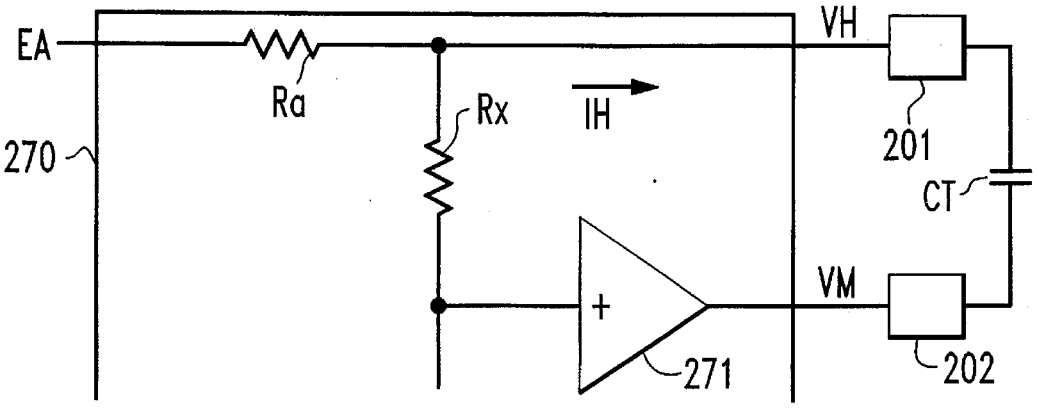
FIG. 42 is a view illustrating a positive feed-back circuit formed in an adjusting circuit as shown in FIG. 34.

FIG. 42 also explains the fact that the operational an amplifier 271 used in the embodiment as shown in FIG. 33, form a positive feedback circuit.

FIG. 42 is modified from FIG. 33 in such a manner that the operational amplifier 271 is converted into an amplifier 271 having only one input terminal only taking positive input terminal thereof into account, in order to get better understanding of this fact.

In that, an output of the amplifier 271 is applied to an one end terminal of an equivalent capacity CT of the liquid crystal display panel through the segment electrode driving circuit 201 and another end terminal of the liquid crystal display panel is connected to an input terminal of the amplifier 271 through a resister R and common electrode driving circuit 202.

As apparent from FIG. 42, it can be understood that the amplifier 271 forms a positive feedback circuit through the capacity CT.

As the same way, it is apparent that the operational amplifier 271 provided in the circuit as shown in FIG. 33 also form a positive feedback circuit through the capacity CT of the liquid crystal with respect to an output terminal VL.

I claim:

1. An electrooptical display device, comprising:

a display panel including a common electrode group having common electrode lines with common electrodes and a segment electrode group having segment electrode lines with segment electrodes;

a driving power source;

a common electrode driving circuit coupled between the driving power source and the display panel for driving the common electrode lines;

a segment electrode driving circuit coupled between the driving power source and the display panel for driving the segment electrode lines; and an adjusting circuit including current detection means for detecting actual current flowing through the display panel, said detected current varying with the driving voltage of the display panel, said adjusting circuit including voltage control means responsive to a change in the detected actual current for steeply increasing or decreasing the level of the driving voltage from a normal level thereof for a short period to add an impulse correction voltage to the driving voltages applied to at least one of said segment electrode and said common electrode driving circuits for correcting deformation of waveforms of the driving voltage.

2. The electrooptical display device of claim 1 wherein the adjusting circuit includes means for providing positive feedback to increase current flowing into a load of said display panel.

3. The electrooptical display device of claim 2, wherein the display panel comprises a plurality of liquid crystals; and wherein the positive feedback means includes means for generating charge current to fully charge total capacitance of the display panel.

4. The electrooptical display device of claim 1 wherein the current detection means is connected to at least one of said common electrode and said segment electrode driving circuits, and said voltage control means is connected to at least the one of said common electrode and said segment electrode driving circuits disconnected from the current detection means.

5. The electrooptical device of claim 1 wherein the current detection means is connected to at least one of said common electrode and said segment electrode driving circuits, and the voltage control means is connected to said at least one driving circuit through said current detection means.

6. The electrooptical device of claim 5 wherein the current detection means includes means for detecting current flowing through one of the common and segment electrode driving circuits;

the voltage control means including means for controlling a voltage of one of the common and segment electrode being integrated with the current detection means to form one circuit;

said one circuit including;

an operational amplifier having a negative input terminal, a positive input terminal, and an output terminal;

the output terminal being connected to one of the common and segment electrode driving circuits and fed back to the negative input terminal, the positive input terminal being set to a reference voltage level corresponding to the voltage setting of one of the common and segment electrode driving voltages, the output of this operational amplifier being positively fed back to the positive input terminal through a capacitance.

7. The electrooptical display device of claim 6, wherein a resistor is inserted in a positive feed-back circuit coupled between the positive input terminal and output of the operational amplifier.

8. An electrooptical display device according to claim 6, wherein the current detection means includes means for detecting current flowing through said common electrode driving circuit and said voltage control means includes means for controlling voltage of said common electrode group.

9. The electrooptical display device of claim 1, wherein both said current detection means and said voltage control means are connected to both said common electrode and said segment electrode driving circuits.

10. The electrooptical display device of claim 1, wherein said current detection means is connected to one of said common electrode and said segment electrode driving circuits, are said voltage control means is connected to both of said common electrode and said segment electrode driving circuits.

11. The electrooptical display device of claim 10 wherein the voltage control means comprises a first voltage control and a second voltage control means separate from one another; and the current detection means and the first voltage control means being connected to one of said common electrode and said segment electrode driving circuits, the second voltage control means being connected to the other of the common electrode and segment electrode driving circuits.

12. The electrooptical display device of claim 11, wherein said second voltage control means is controlled by said current detection means.

13. The electrooptical display device of claim 1 wherein the voltage control means includes means for controlling the voltage of all but a selected common electrode in the common electrode group; and wherein the current detection means includes means for detecting the current in all but a selected common electrode in the common electrode group.

14. The electrooptical display device of claim 1 wherein at least one of the current detection means and the voltage control means is disconnected from common electrodes selected by the common electrode driving circuit.

15. The electrooptical display device of claim 1 wherein the driving power source circuit comprises, means for applying a plurality of segment electrode driving voltages to said segment electrode driving circuit.

16. The electrooptical display device of claim 15 wherein the adjusting circuit comprises in the alternative a plurality of the voltage control means or a plurality of the current detection means connected to the respective plurality of segment electrode driving voltage sources.

17. The electrooptical display device of claim 15 wherein the adjusting circuit comprises a plurality of voltage control means connected to the segment electrode driving circuit of the display panel; each of said plurality being controlled by an output signal from the current detection means; and the current detection means being connected to the common electrode driving circuit.

18. The electrooptical device of claim 17 wherein the current detection means is connected for detecting current flowing through the common electrode driving circuit;

the current detection means includes a first operational amplifier having an output, a negative input terminal, and a positive input terminal, a current detection resistor connected to the output of the first operational amplifier;

the voltage control means includes a first and second voltage control means, each said first and second voltage control means being connected to a respective segment electrode driving source, each of the first and second voltage control means includes, a second operational amplifier having an output terminal, a negative input terminal and a positive input terminal, the output terminal being connected to one of the common electrode and segment electrode driving circuits, the positive input terminal being at a reference voltage level of a driving voltage applied to said one of the common and segment electrode driving circuits, the negative input terminal being at a voltage level determined in accordance with the voltage at the positive input terminal and a variable voltage corresponding to current flowing into the display panel, and a feedback resistor connecting the output terminal to the negative input terminal;

the first voltage control means being connected to one of the plurality of segment electrode driving voltage source and the second voltage control means connected to another of the said signal electrode driving voltage source; and the negative input terminal each of the second operational amplifier of the voltage control means being connected to the output of the first operational amplifier of the current detection means; each one of the reference voltages of the plurality of segment electrode driving voltage source being input to the positive input terminals of the respective second operational amplifiers of the first and the second voltage control means.

19. The electrooptical display device of claim 15 wherein the current detection means comprises a plurality of current detection means connected to the segment electrode driving circuit of the display panel; and the voltage control means being connected to the common electrode driving circuit, and controlled by each one of the plurality of current detection means.

20. The electrooptical device of claim 19 wherein each of the plurality of current detection circuits comprises a first operational amplifier having an output, a negative input terminal, a positive input terminal, and a current detection resistor connected to the output of the operational amplifier, the plurality of current detection means includes a first current detection means connected to one of the segment electrode driving voltage sources and a second current detection means connected to the other one of the segment electrode driving voltage sources, the output of each first operational amplifier being connected to the voltage control means and fed back through the current detection resistor to the negative input terminal, the negative input terminal being connected to one of the common electrode and the segment electrode driving circuits, the positive input terminal being at a reference voltage level applied to said one of the common electrode and the segment electrode driving circuits connected to the negative input terminal;

the voltage control means comprising, a second operational amplifier having an output terminal, a negative input terminal and a positive input terminal;

the output terminal being connected to one of the common electrode and segment electrode driving circuits, the positive input terminal being set at a reference voltage level of a driving voltage applied to said one of the common and segment electrode driving circuits, the negative input terminal being at a voltage level determined in accordance with the voltage at the positive input terminal and a variable voltage corresponding to current flowing into the display panel and a feedback resistor connecting the output terminal to the negative input terminal;

the output of the first current detection means and the second current detection means being connected to the negative input of the second operational amplifier and the positive input terminal of the second operational amplifier being connected to each one of the reference voltages of the plurality of segment electrode driving voltage sources.

21. The electrooptical display device of claim 19, wherein the plurality of the current detection means comprises a first current detection means connected to one of said plurality of segment electrode driving voltage sources for detecting current through said segment electrode driving circuit and a second current detection means connected to another one of said segment electrode driving voltage sources for detecting current flowing through said segment electrode driving circuit;

the voltage control means being connected to both of said first and second current detection means and driving voltage sources and further connected to said common electrode driving circuit, the first and second current detection means and the voltage control means including the voltage control means including means controlling a voltage of one of the common and segment electrode being integrated with the current detection means to form one circuit;

said one circuit including;

an operational amplifier having a negative input terminal, a positive input terminal, and an output terminal;

the output terminal being connected to one of the common and segment electrode driving circuits and fed back to the negative input terminal, the positive input terminal being set to a reference voltage level corresponding to the voltage setting of one of the common and segment electrode driving voltages, the output of this operational amplifier being positively fed back to the positive input terminal through a capacitance; and the output of the first and second current detection means being input to the negative input terminal of the voltage control means.

22. The electrooptical display device of claim 1 wherein the current detection means comprises an operational amplifier having an output, a negative input terminal, and a positive input terminal and a current detection resistor connected to the output of the operational amplifier;

the output of the operational amplifier being connected to the voltage control means and fed back through the current detection resistor to the negative input terminal, the negative input terminal being connected to one of said common electrode driving circuit and said segment electrode driving circuit, the positive input terminal being at a reference voltage level applied to the one of said common electrode driving circuit and the segment electrode driving circuit that is connected to the negative input terminal.

23. The electrooptical device of claim 22 wherein the display panel comprises a substrate, and the current detection resistor is mounted on the substrate.

24. The electrooptical device of claim 23 wherein the display panel has an inner resistance; and the current detection resistance includes the inner resistance of the display panel.

25. An electrooptical display device according to claim 1 wherein the voltage control means comprises:

an operational amplifier having an output terminal, a negative input terminal and a positive input terminal;

the output terminal being connected to one of the common electrode driving circuit and segment electrode driving circuit, the positive input terminal being set to a reference voltage level of a driving voltage applied to said common electrode driving circuit;

the negative input terminal being connected to the current detection means; and a feedback resistor connecting the output terminal to the negative input terminal.

26. The electrooptical display device of claim 25, wherein each of said first and second current detection means comprises a plurality of primary coils connected between a reference voltage source of one of said segment and common electrode driving voltages and one of said segment and common electrode driving circuits, and a plurality of secondary coils connected to the voltage control means.

27. An electrooptical display device according to claim 1, wherein the current detection means is comprised of resistance.

28. An electrooptical display device according to claim 27, wherein the resistance includes resistors mounted on a substrate of the display panel.

29. The electrooptical display device of claim 28, wherein the resistance includes an inner resistance of the display panel.

30. An electrooptical display device according to claim 1, wherein the current detection means includes means for detecting a total current flowing through the entire display panel, the voltage control means including means for adjusting voltage variation of both said common segment electrode driving voltages of the display panel.

31. An electro-optical display device according to claim 1, wherein said adjusting circuit includes means for adjusting said deformation of said wave-form by rapidly varying the driving voltage applied to at least one group of electrodes selected from the common electrodes group and the segment electrodes group of said display panel.

32. An electro-optical display device according to claim 31, wherein a voltage level of said driving voltage applied to at least one group of electrodes selected from the common electrodes group and the segment electrodes group of said display panel is steeply increased at the beginning of a period when said driving voltage is initially supplied thereto so as to form a rising edge.

33. An electro-optical display device according to claim 31, wherein a voltage level of said driving voltage applied to at least one group of electrodes selected from the common electrodes group and the segment electrodes group of said display panel exceeds the normal level of the voltage, a period when said driving voltage is initially supplied thereto, so as to form a rising edge.

34. An electro-optical display device according to claim 1, wherein said current detection means is connected to said segment electrode driving circuit; and said voltage control means comprises:

an operational amplifier having an output terminal, a negative input terminal, and a positive input terminal, the output terminal being connected to said common electrode driving circuit, and fed back to the negative input terminal through a resistor, the negative input terminal further being connected to a reference voltage of a driving voltage applied to said common electrode driving circuit, the positive input terminal being connected to said current detection means and set at a voltage level determined in accordance with the reference voltage and a variable voltage corresponding to current flowing into the display panel.

* * * * *